US008109490B2

(12) United States Patent
Ahn

(10) Patent No.: US 8,109,490 B2
(45) **Date of Patent: *Feb. 7, 2012**

(54) SPRING STRUCTURE HAVING CONTACT-PREVENTING AND RIGIDITY-REINFORCING FUNCTION FOR BED MATTRESS

(75) Inventor: Yoo Soo Ahn, Kyonggi-Do (KR)

(73) Assignee: Ace Bed Co., Ltd., Kyonggi-Do (KR)

( * ) Notice: Subject to any disclaimer, the term of this patent is extended or adjusted under 35 U.S.C. 154(b) by 1083 days.

This patent is subject to a terminal disclaimer.

(21) Appl. No.: 11/471,413

(22) Filed: Jun. 19, 2006

(65) Prior Publication Data

US 2007/0235915 A1 Oct. 11, 2007

(30) Foreign Application Priority Data

Apr. 7, 2006 (KR) ..... 10-2006-0031670

(51) Int. Cl.
*F16F 1/06* (2006.01)

(52) U.S. Cl. ..... 267/179; 267/85; 267/88

(58) Field of Classification Search ..... 267/83, 267/85, 86, 88, 92, 180, 107, 109, 75, 131, 267/142, 170, 171, 178, 179
See application file for complete search history.

(56) References Cited

U.S. PATENT DOCUMENTS 2,668,278 A * 2/1954 Avery ..... 439/384
7,404,223 B2 * 7/2008 Manuszak et al. ..... 5/716

* cited by examiner

*Primary Examiner* — Bradley King
(74) *Attorney, Agent, or Firm* — Edwards Wildman Palmer LLP; Peter F. Corless

(57) ABSTRACT

Disclosed herein is a spring structure having a contact-preventing and rigidity-reinforcing function for a bed mattress in which the structure of a connection end portion for connecting a body spring and an exposure wire spring to each other is improved such that the connection end portion is not in close contact with an uppermost winding and/or a lowermost winding of the body spring and such that when a load is exerted to an exposure wire spring a displacement is prevented from being generated in which the exposure wire spring is leaned to one side, and rigidity of the spring is reinforced so that the exposure wire spring ascends/descends vertically only, thereby easily preventing the lateral displacement and deformation of the spring along with a prevention of a noise due to a frictional contact to prolong the lifespan of the spring.

15 Claims, 28 Drawing Sheets

THE STATE WHERE FIRST CONTACT-PREVENTING/RIGIDITY-REINFORCING END 30 DESCENDS WITHOUT TOUCHING THE UPPERMOST WINDING 12

THE STATE WHERE FIRST CONTACT-PREVENTING/RIGIDITY-REINFORCING END 30 DESCENDS WITHOUT TOUCHING THE UPPERMOST WINDING 12

THE STATE WHERE FIRST CONTACT-PREVENTING/RIGIDITY-REINFORCING END 30 DESCENDS TOWARD CONTACT-PREVENTING SPACE BEHIND SECOND CONTACT-PREVENTING/RIGIDITY-REINFORCING END 32 WITHOUT TOUCHING THE UPPERMOST WINDING 12

THE STATE WHERE FIRST CONTACT-PREVENTING/RIGIDITY-REINFORCING END 30 DESCENDS TOWARD CONTACT-PREVENTING SPACE BEHIND SECOND CONTACT-PREVENTING/RIGIDITY-REINFORCING END 32 WITHOUT TOUCHING THE UPPERMOST WINDING 12

SPRING STRUCTURE HAVING CONTACT-PREVENTING AND RIGIDITY-REINFORCING FUNCTION FOR BED MATTRESS

BACKGROUND OF THE INVENTION

1. Field of the Invention

The present invention relates to a spring structure having a contact-preventing and rigidity-reinforcing function for a bed mattress, and more particularly to such a spring structure having a contact-preventing and rigidity-reinforcing function for a bed mattress in which the structure of a connection end portion for connecting a body spring and an exposure wire spring to each other is improved such that the connection end portion is not in close contact with an uppermost winding and/or a lowermost winding of the body spring and such that when a load is exerted to an exposure wire spring a displacement is prevented from being generated in which the exposure wire spring is leaned to one side, and rigidity of the spring is reinforced so that the exposure wire spring ascends/descends vertically only, thereby easily preventing the lateral displacement and deformation of the spring, preventing a noise due to a frictional contact, and extending the lifespan of the spring.

2. Background of the Related Art

In general, a bed mattress is mounted on a bed frame and is used as means adapted to provide a cushion force and buffering force. The bed mattress basically includes a spring assembly, an intermediate member laminatedly attached on the upper and lower surfaces of the spring assembly, an edge former fittingly attached to the circumferential edge of the spring assembly, and a cover member for protecting the surfaces of the intermediate member and the edge former.

Especially, the spring assembly is composed of springs vertically arranged spaced apart from one another at regular intervals over the entire area of the bed mattress, and a helical coil for securely engaging the springs with one another.

Herein, in order to better understand the present invention, a process for manufacturing a bed mattress will be hereinafter described in brief with reference to FIG. 13.

Referring to FIG. 13, the process for manufacturing the bed mattress includes the following steps of: fabricating a spring assembly 2 including coil springs arranged along row and column directions over the entire area of the bed mattress in such a fashion as to be spaced apart from one another at regular intervals, the coil springs being securely fixed by means of a helical coil; fittingly attaching an edge former as a support means to the circumferential edge of the spring assembly, and then continuously laminating multi-layered cushion means including a felt and a non-woven fabric as an intermediate member 4 on the upper and lower surfaces of the spring assembly 2; and covering the upper and lower surfaces and the circumferential edge surface of the intermediate member 4 as well as the outer surface of the edge former 3 with a cover 5, and then hermetically sealing a seam portion of the cover 5 with a sealing means 6.

Therefore, when a user sleeps or takes a rest, a load exerted to the bed mattress is absorbed and buffered by means of a cushion force of the intermediate member and a buffering force of the spring so that he or she can feel convenience and comfort.

Now, a spring structure for a conventional bed mattress constituting the spring assembly will be described hereinafter with reference to FIGS. 10*a* and 10*b*.

FIGS. 10*a* and 10*b* illustrate an example of a conventional spring structure.

Referring to FIGS. 10*a* and 10*b*, a conventional spring 600 includes a body spring 10 formed in a coil shape whose diameter is gradually increased as it goes toward the top and the bottom from the central portion thereof, an upper end spring 16 wound and extending horizontally at a terminating point of the uppermost winding 12 of the body spring 10, and a lower end spring 18 wound and extending horizontally at a terminating point of the lowermost winding 14 of the body spring 10.

In this case, a distal end of the upper end spring 16 is fixed in such a fashion as to be twisted at the terminating point of the uppermost winding 12 of the body spring 10, and a distal end of the lower end spring 18 is fixed in such a fashion as to be twisted at the terminating point of the lowermost winding 14 of the body spring 10.

However, when the bed mattress is manufactured by employing the conventional spring, there are the following demerits:

A large or small load applied to the bed mattress is finally buffered and absorbed by the spring.

In this manner, when different loads are irregularly concentrated on the spring, there is a risk that the deformation of the spring may be progressed rapidly. In addition, adjacent springs come into close contact with each other according to the deformation of the spring to thereby contribute to the generation of a noise.

In view of these problems, another type of spring which has a dual buffer structure to decentrally buffer the larger and smaller loads separately has been manufactured, and its shape is shown in FIGS. 11*a* to 11*c*.

Referring to FIGS. 11*a* to 11*c*, a conventional spring 700 of another type, as shown in FIGS. 10*a* and 10*b*, includes a body spring 10 formed in a coil shape whose diameter is gradually increased as it goes toward the top and the bottom from the central portion thereof, an upper end spring 16 wound and extending horizontally at a terminating point of the uppermost winding 12 of the body spring 10, and a lower end spring 18 wound and extending horizontally at a terminating point of the lowermost winding 14 of the body spring 10. The spring 700 is characterized in that a separate exposure wire spring 20 is formed integrally with the upper end spring 16 in such a fashion as to be disposed above the upper end spring 16.

At this time, a distal end of the upper end spring 16 is connected integrally with the exposure wire spring 20, and a distal end of the lower end spring 18 is fixed in such a fashion as to be twisted at the terminating point of the uppermost winding 14 of the body spring 10.

The exposure wire spring 20 has a diameter smaller than that of the body spring 10 and is configured to be wound in a coil shape. The exposure wire spring 20 also has a resilient force causing compressible deformation thereof relatively easily as compared to the body spring 10.

Especially, since a portion 24 (hereinafter, referred to as "connection end portion") extending from the distal end of the upper end spring 16 to the exposure wire spring 20 runs spirally toward a vertical central axis of the overall spring, the connection end portion 24 and the uppermost wiring 12 for the body spring 10 positioned just below the connection end portion intersect each other when viewed from the top.

Accordingly, in the case where a smaller load (just a load applied to the bed mattress when a user twists and turns in his or her bed mattress) is exerted to the bed mattress, the exposure wire spring 20 buffers/absorbs the load impact. On the other hand, in the case where a larger load (a load applied to the bed mattress when the user sits on the bed mattress) is exerted to the bed mattress, the body spring 10 buffers/absorbs the load impact.

As such, the body spring and the exposure wire spring decentrally perform a buffering function thereof separately depending on the magnitude of the load exerted to the bed mattress to thereby provide advantages of preventing the deformation of the spring and prolonging the lifespan of the spring.

But, the conventional spring 700 of another type with the exposure wire spring has the following demerits:

As shown in FIG. 12, when the exposure wire spring 20 is compressed along with the exertion of a load to the bed mattress, and simultaneously the connection end portion 24 for connecting the distal end of the upper end spring 16 and the exposure wire spring 20 to each other is applied with a compression load, the connection end portion 24 and the uppermost wiring 12 for the body spring 10 positioned just below the connection end portion intersect each other when viewed from the top as described above. Thus, the connection end portion 24 comes into close contact with the uppermost wiring 12 while descending, to thereby generate the noise due to the contact therebetween.

Moreover, in the case where a larger load is exerted to the bed mattress, the exposure wire spring 20 is compressed and simultaneously the body spring 10 is also compressed, so that the connection end portion 24 also descends upon the compression of the exposure wire spring 20. At this time, the connection end portion 24 comes into close contact with the uppermost winding 12 of the body spring 10 with a larger impact, to thereby generate a larger contact noise.

As such, the contact noise caused by the spring during the use of the bed mattress acts as a great stress to a user, which may become a critical disadvantage for bed mattress products.

In addition, if the connection end portion repeatedly comes into close with the uppermost winding of the body spring by friction, it will not be long before the spring itself is deformed.

Moreover, since the direction of a load exerted to the bed mattress is not oriented uniformly such as vertically or slantly, there may occur a problem in that the exposure wire spring having a relatively weak rigidity as compared to that of the body spring is easily displaced laterally.

In this manner, when the exposure wire spring 20 is displaced in one direction, there is a problem in that an area of the bed mattress is locally depressed and a uniform cushion sense is not provided over the entire area of the bed mattress.

SUMMARY OF THE INVENTION

Accordingly, the present invention has been made in view of the aforementioned problems occurring in the prior art, and it is an object of the present invention to provide a spring structure having a contact-preventing and rigidity-reinforcing function for a bed mattress in which the structure of a connection end portion for connecting a body spring and an exposure wire spring to each other is improved in such a fashion as to concurrently achieve a contact-preventing function in which the connection end portion is not in close contact with an uppermost winding and/or a lowermost winding of the body spring as well as a rigidity-reinforcing function in which the exposure wire spring is guided to stably ascend/descend vertically only, but not displaced laterally when a load is exerted to the exposure wire spring.

In one aspect, the present invention provides a spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, and a first connection end portion for integrally connecting the upper end spring and the first exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring so that the first exposure wire spring may not be in contact with the uppermost winding of the body spring and with the upper end spring and support rigidity of the exposure wire spring is reinforced.

In another aspect, the present invention provides a spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, and a first connection end portion for integrally connecting the upper end spring and the first exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring so that the first exposure wire spring may not be in contact with the uppermost winding of the body spring and with the upper end spring and support rigidity of the exposure wire spring is reinforced, and wherein a second contact-preventing/rigidity-reinforcing end is formed at the uppermost winding of the body spring positioned below the first contact-preventing/rigidity-reinforcing end in such a fashion as to be bent in a "Z" shape upwardly from a terminating point of the uppermost winding of the body spring to a starting point of the upper end spring.

In still another aspect, the present invention provides a spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, and a first connection end portion for integrally connecting the upper end spring and the first exposure wire spring to each other, a second exposure wire spring formed integrally with the lower end spring in such a fashion as to be disposed below the lower end spring, and a second connection end portion for integrally connecting the lower end spring and the second exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring, so that the first exposure wire spring may not be in contact with the uppermost winding of the body spring and with the upper end spring and support rigidity of the exposure wire spring is reinforced, and wherein a third contact-preventing/rigidity-reinforcing end is formed at the second connection end portion in such a fashion as to be bent in a "Z" shape downwardly from a distal end of the lower end spring positioned outwardly from a lowermost winding of the body spring.

In still yet another aspect, the present invention provides a spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, and a first connection end portion for integrally connecting the upper end spring and the first exposure wire spring to each other, a second exposure wire spring formed integrally with the lower end spring in such a fashion as to be disposed below the lower end spring, and a second connection end portion for integrally connecting the lower end spring and the second exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring, so that the first exposure wire spring may not be in contact with the uppermost winding of the body spring and with the upper end spring and support rigidity of the exposure wire spring is reinforced, wherein a second contact-preventing/rigidity-reinforcing end is formed at the uppermost winding of the body spring positioned below the first contact-preventing/rigidity-reinforcing end in such a fashion as to be bent in a "Z" shape upwardly from a terminating point of the uppermost winding of the body spring to a starting point of the upper end spring, wherein a third contact-preventing/rigidity-reinforcing end is formed at the second connection end portion in such a fashion as to be bent in a "Z" shape downwardly from a distal end of the lower end spring positioned outwardly from a lowermost winding of the body spring, and wherein a fourth contact-preventing/rigidity-reinforcing end is formed at the lowermost winding of the body spring positioned below the first contact-preventing/rigidity-reinforcing end in such a fashion as to be bent in a "Z" shape downwardly from a terminating point of the lowermost winding of the body spring to a starting point of the lower end spring.

In a further aspect, the present invention provides a spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, and a first connection end portion for integrally connecting the upper end spring and the first exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring, so that the first exposure wire spring may not be in contact with the uppermost winding of the body spring and with the upper end spring and support rigidity of the exposure wire spring is reinforced, wherein a second contact-preventing/rigidity-reinforcing end is formed at the uppermost winding of the body spring positioned below the first contact-preventing/rigidity-reinforcing end in such a fashion as to be bent in a "Z" shape upwardly from a terminating point of the uppermost winding of the body spring to a starting point of the upper end spring, and wherein a fourth contact-preventing/rigidity-reinforcing end is formed at a lowermost winding of the body spring in such a fashion as to be bent in a "Z" shape downwardly from a terminating point of the lowermost winding of the body spring to a starting point of the lower end spring.

Preferably, each of the first, second, third, and fourth contact-preventing ends has a height of 5 to 60 mm.

Suitably, the "Z"-shape bent angle of the first, second, third, and fourth contact-preventing/rigidity-reinforcing ends with respect to a vertical axis of the body spring is in the range between 0° and 70°.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIGS. 9*a* and 9*b* are perspective views illustrating a spring structure for a bed mattress according to the fifth embodiment of the present invention, in which an exposure wire spring is connected to an upper end spring thereof, wherein FIG. 9*a* shows a state where the exposure wire spring is formed at an upper portion thereof and FIG. 9*b* shows a state where the exposure wire spring is formed at upper and lower portions thereof;

DETAILED DESCRIPTION OF THE PREFERRED EMBODIMENT

Reference will now be made in detail to the preferred embodiment of the present invention with reference to the attached drawings.

Figure 1A:
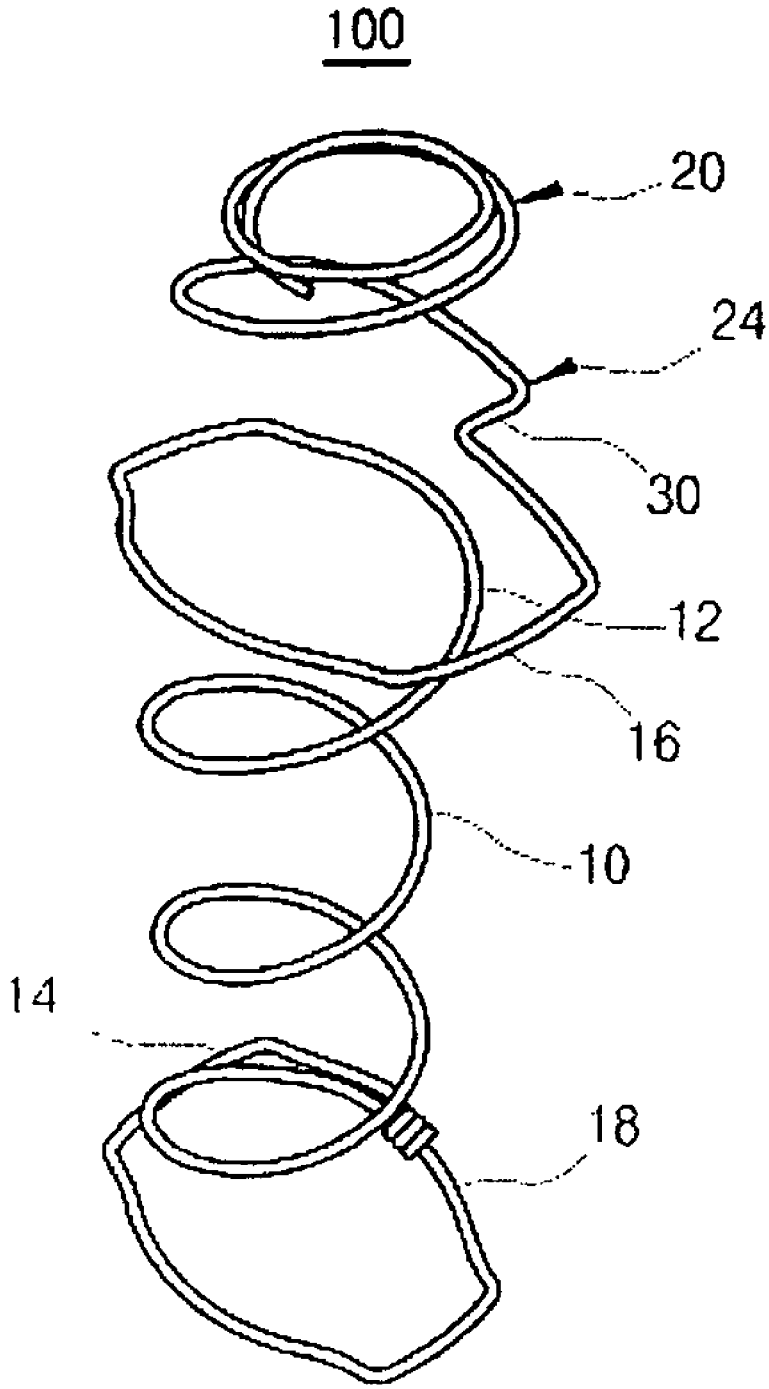
FIGS. 1*a*, 1*b* and 1*c* are a perspective view, a front view, and a side view illustrating a spring structure for a bed mattress according to the first embodiment of the present invention.
Figure 1B:
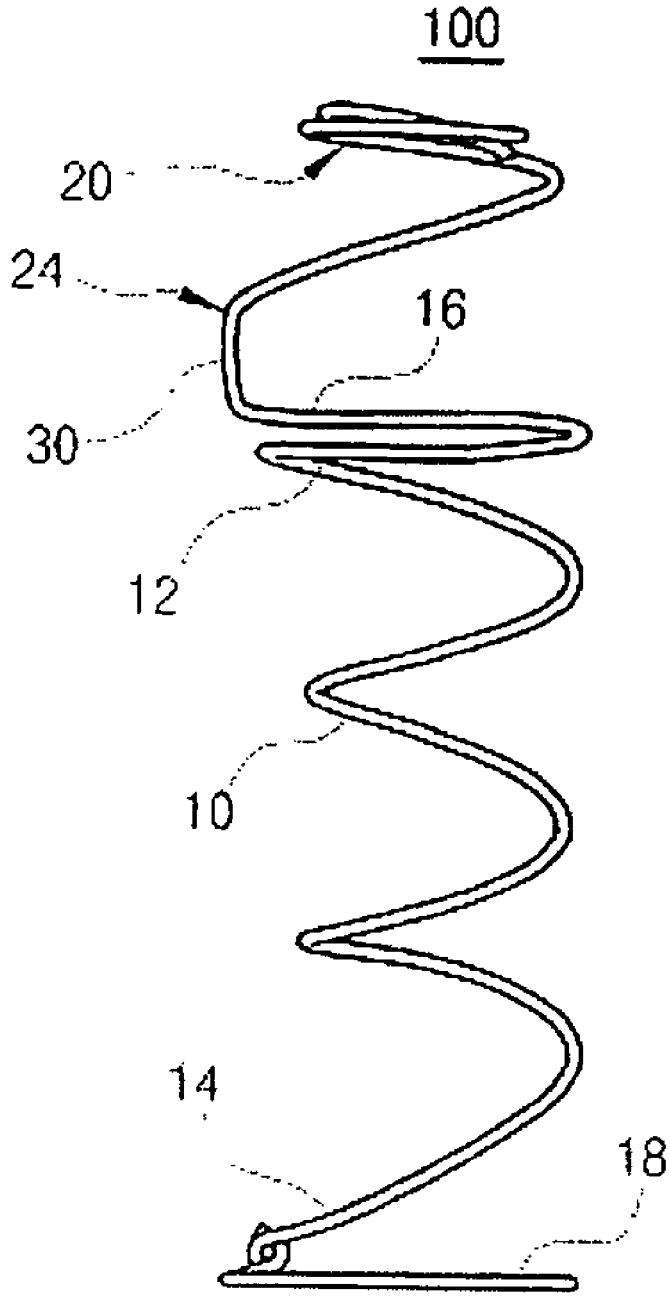
Figure 1C:
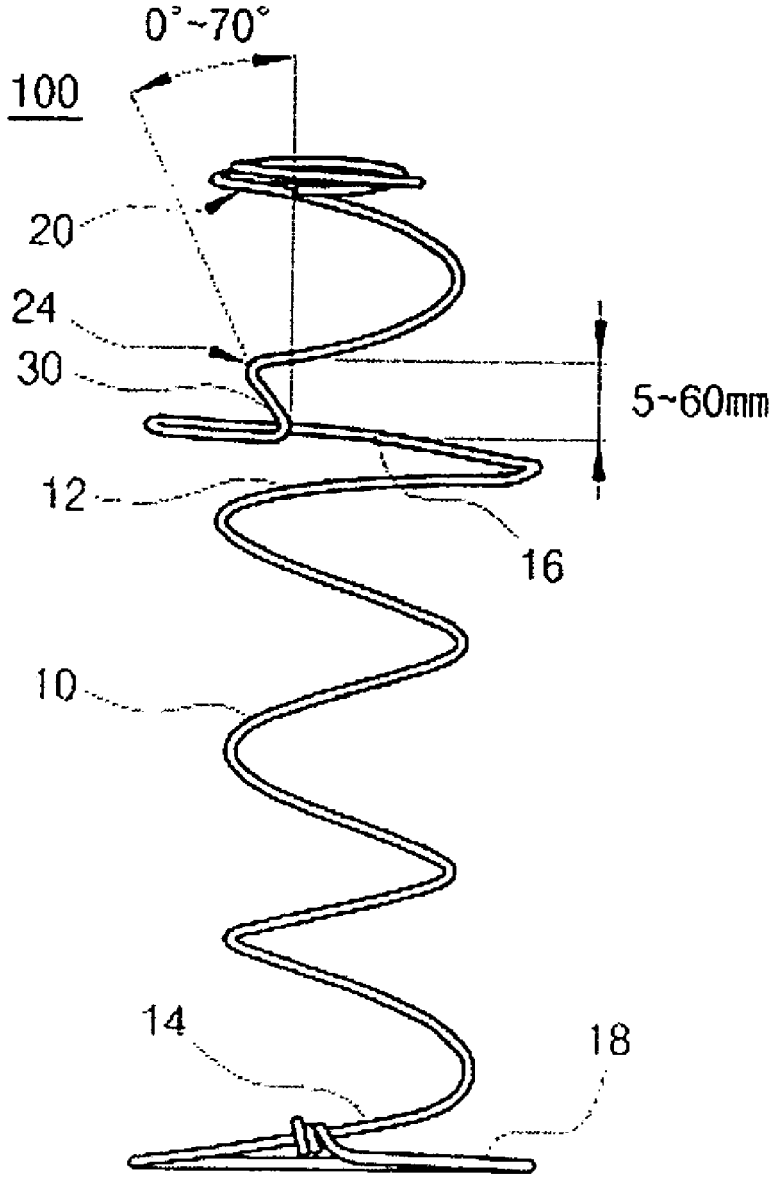
Figure 2A:
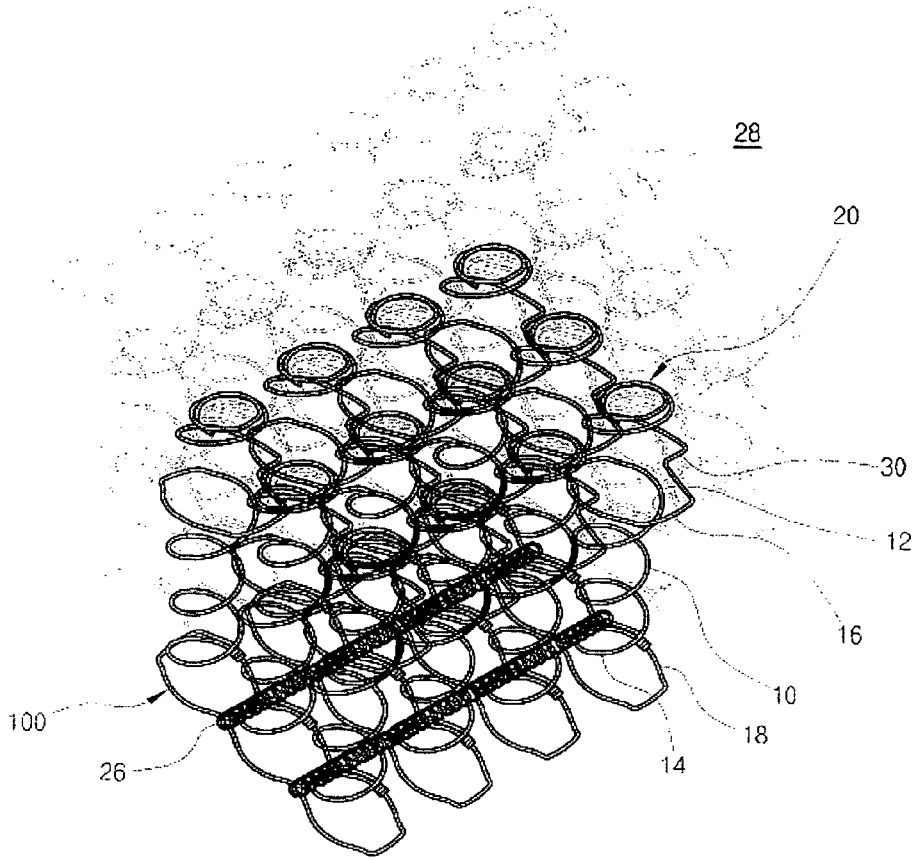
FIGS. 2*a*, 2*b* and 2*c* are a perspective view, a front view, and a side view illustrating the states where the spring structure according to the first embodiment of the present invention is assembled in a spring assembly.
Figure 2B:
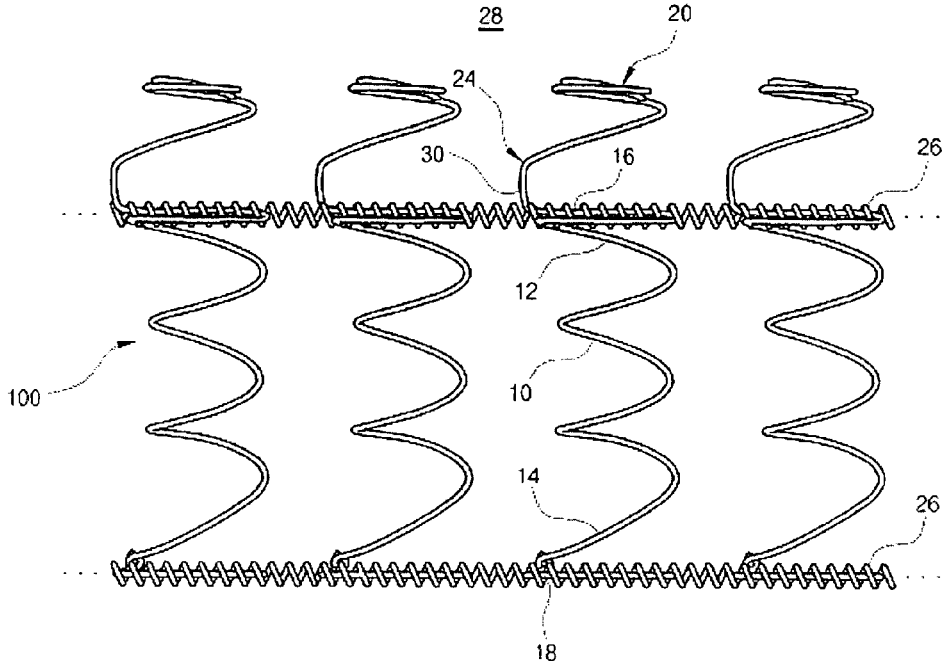
Figure 2C:
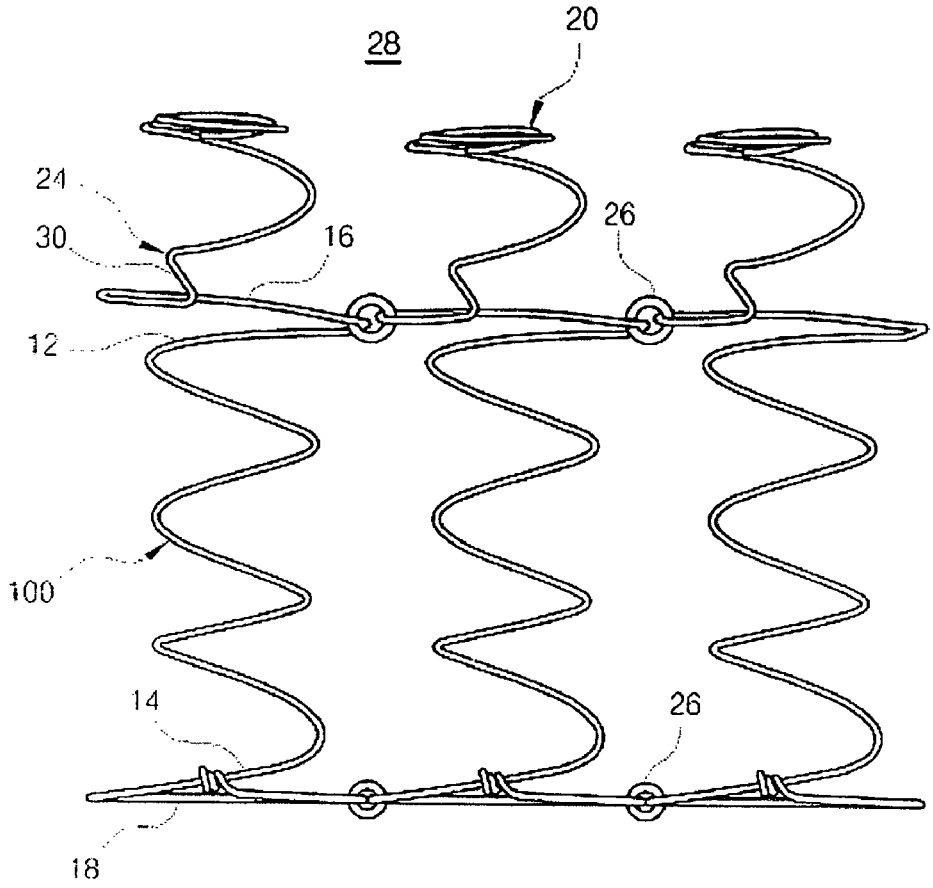
Figure 3A:
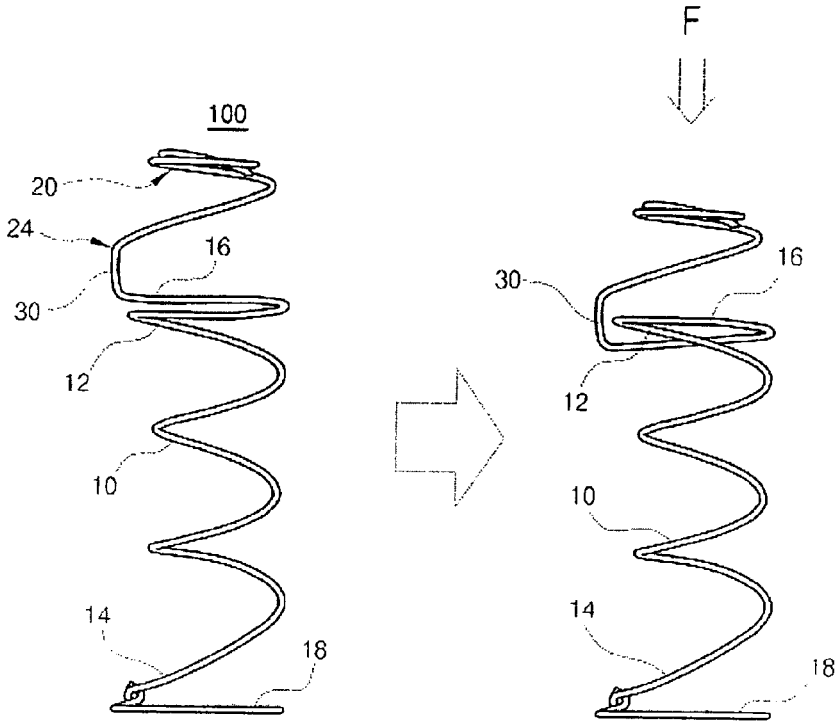
FIGS. 3*a* and 3*b* are a front view and a side view illustrating the compression actions of the spring structure according to the first embodiment of the present invention.
Figure 3B:
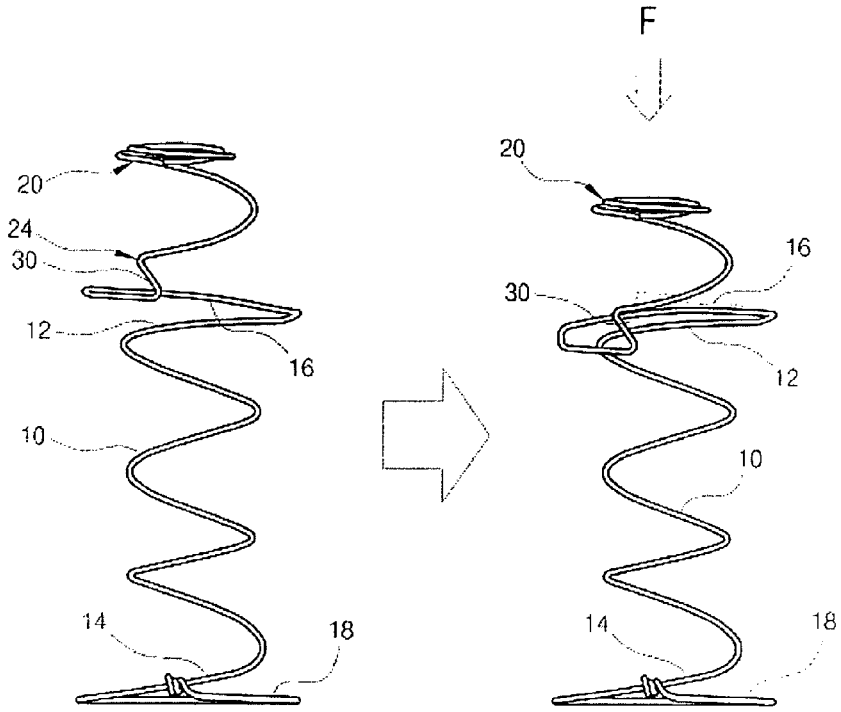

FIGS. 1*a*, 1*b* and 1*c* are a perspective view, a front view, and a side view illustrating a spring structure 100 for a bed mattress according to the first embodiment of the present invention, FIGS. 2*a*, 2*b* and 2*c* are a perspective view, a front view, and a side view illustrating the states where the spring structure 100 according to the first embodiment of the present invention is assembled in a spring assembly, and FIGS. 3*a* and 3*b* are a front view and a side view illustrating the compression actions of the spring structure 100 according to the first embodiment of the present invention.

Referring to the drawings, a spring structure for a bed mattress, which can perform a buffering function separately depending on the magnitude of a load exerted to the bed mattress, comprises a body spring 10 formed in a coil shape, upper and lower end springs 16 and 18 wound and extending horizontally at upper and lower portions of the body spring, an exposure wire spring 20 formed integrally with the upper end spring 16 in such a fashion as to be disposed above the upper end spring 16, and a connection end portion 24 for integrally connecting the upper end spring and the exposure wire spring to each other.

Especially, the exposure wire spring 20 has a diameter smaller than that of the body spring 10 in such a fashion that the diameter thereof is smaller as it goes toward the top and is configured to be wound in a coil shape.

A single spring unit for the bed mattress including the body spring 10 and the exposure wire spring 20 is fabricated as a spring assembly 2, as shown in FIGS. 2*a* to 2*c*, which is composed of springs arranged spaced apart from one another at regular intervals along row and column directions over the entire area of the bed mattress, and helical coils 26 for securely engaging one side ends of the upper and lower end springs 16 and 18 of adjacent springs for bed mattress with one another. Here, the spring structure 100 according to the first embodiment of the present invention features that a first contact-preventing/rigidity-reinforcing end 30 is formed at the connection end portion for integrally connecting the upper end spring 16 and the exposure wire spring 20 in such a fashion as to be bent in a "Z" shape upwardly from a distal end of the upper end spring positioned outwardly from an uppermost winding of the body spring 10.

More specifically, the first contact-preventing/rigidity-reinforcing end 30 is a wire section bent in a "Z" shape upwardly (vertically) from a distal end of the upper end spring 16 positioned outwardly from an uppermost winding 12 of the body spring 10.

In other words, when viewed from the top, the first contact-preventing/rigidity-reinforcing end 30 is disposed outwardly from an uppermost winding 12 of the body spring 10 without being crossed or overlapped. Thus, upon the compression of the exposure wire spring 20 the first contact-preventing/rigidity-reinforcing end 30 descends while passing by the uppermost winding 12 of the body spring 10 without touching the uppermost winding 12, thereby preventing the contact between the connection end portion 24 and the uppermost winding 12 and a noise due to the contact occurring in the conventional spring having a dual buffer structure (see FIGS. 11*a*, 11*b*, 11*c* and 12).

However, in the spring structure according to the first embodiment of the present invention, as shown in FIGS. 3*a* and 3*b*, the first contact-preventing/rigidity-reinforcing end 30 is formed at the connection end portion 24. Thus, when a load is exerted to the bed mattress to compress the exposure wire spring 20, the first contact-preventing/rigidity-reinforcing end 30 descends while passing by the uppermost winding 12 of the body spring 10 positioned just therebelow without touching the uppermost winding 12, thereby fully eliminating the noise itself that can be otherwise caused if there is such contact between the connection end portion 24 of the exposure wire spring 20 and the uppermost winding 12.

Particularly, the first contact-preventing/rigidity-reinforcing end 30 is enhanced in its rigidity while being bent in a "Z" shape, i.e., is enhanced in its rigidity required to support the exposure wire spring 20 so that a lateral displacement is not generated in which the exposure wire spring 20 is leaned to one side along with exertion of a load to the exposure wire spring 20 but stably ascends/descends vertically only so as to provide a uniform cushion sense.

More specifically, as the first contact-preventing/rigidity-reinforcing end 30 is enhanced in its rigidity while being bent in a "Z" shape, it is prevented from being displaced or leaned laterally and serves to stably support the exposure wire spring 20 disposed above the first contact-preventing/rigidity-reinforcing end 30. As a result, when the exposure wire spring 20 is applied with a load, it stably descends/ascends vertically only, but is not displaced laterally so as to provide a uniform cushion sense.

A spring structure 200 for a bed mattress according to the second embodiment of the present invention will now be described hereinafter.

Figure 4A:
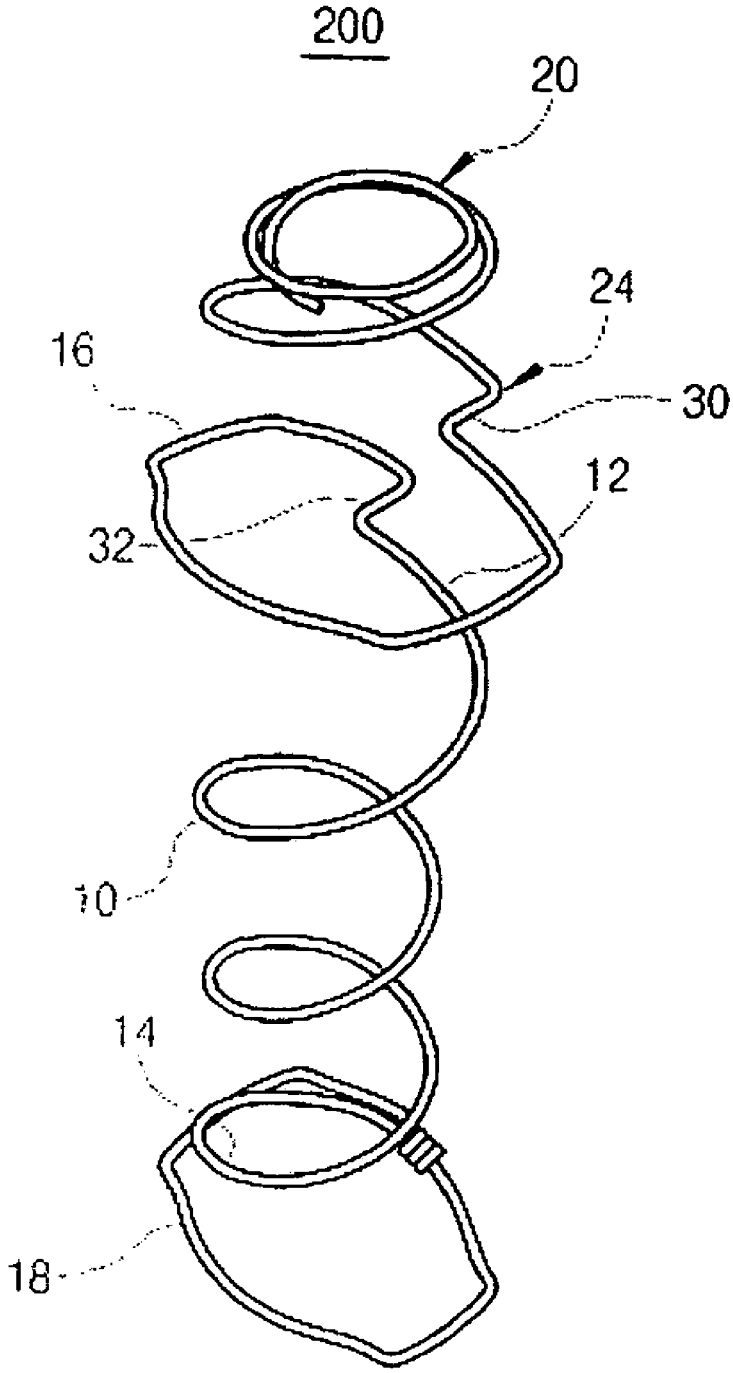
FIGS. 4*a*, 4*b* and 4*c* are a perspective view, a front view, and a side view illustrating a spring structure for a bed mattress according to the second embodiment of the present invention.
Figure 4B:
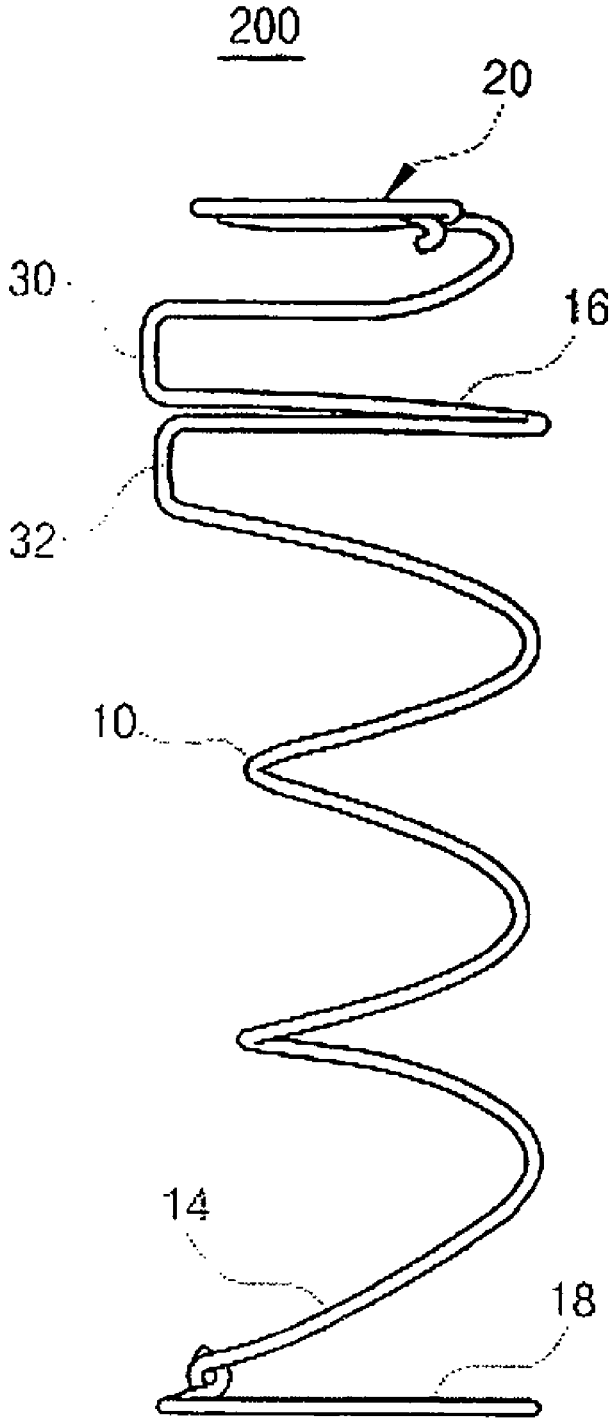
Figure 4C:
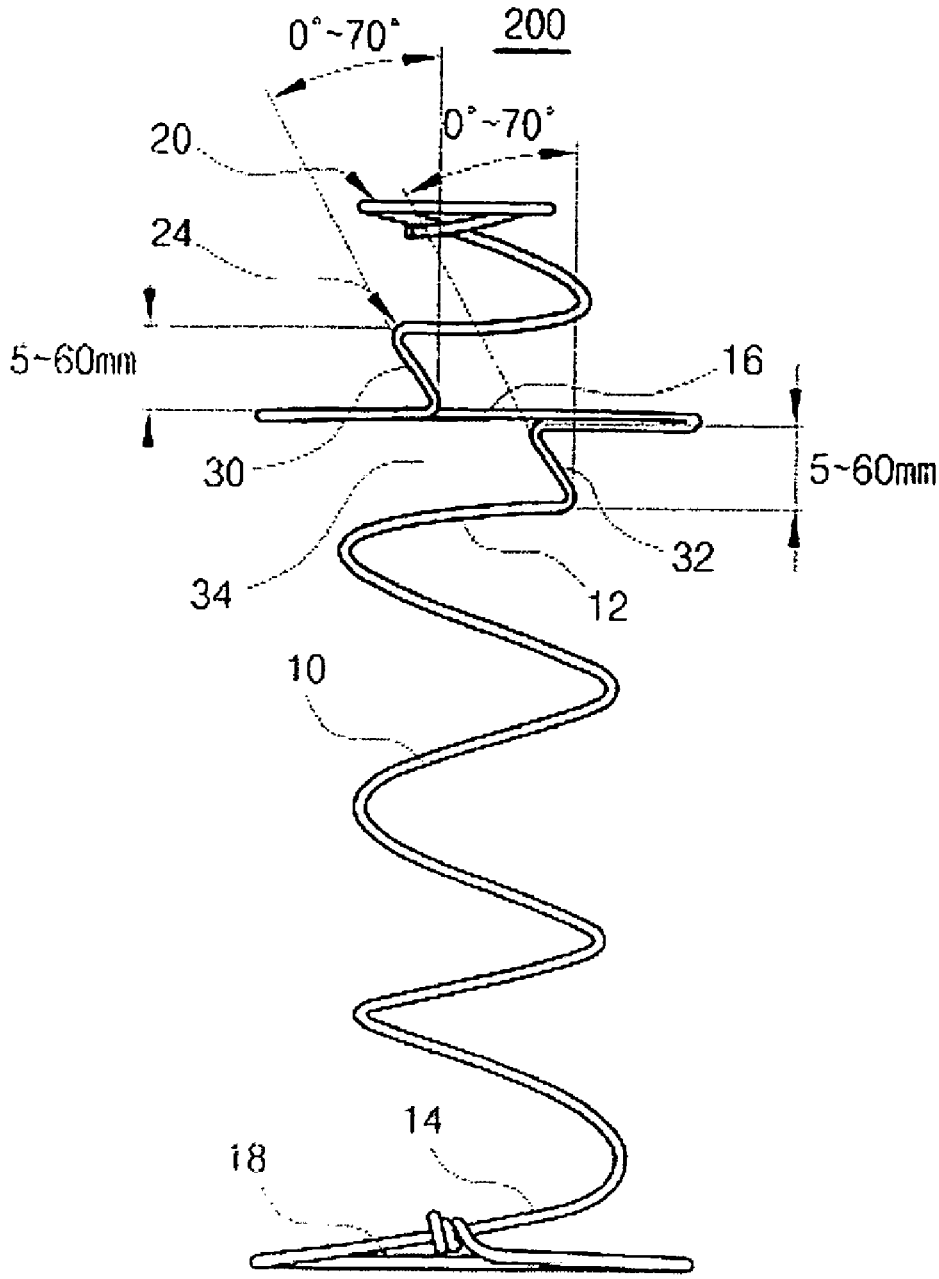
Figure 5A:
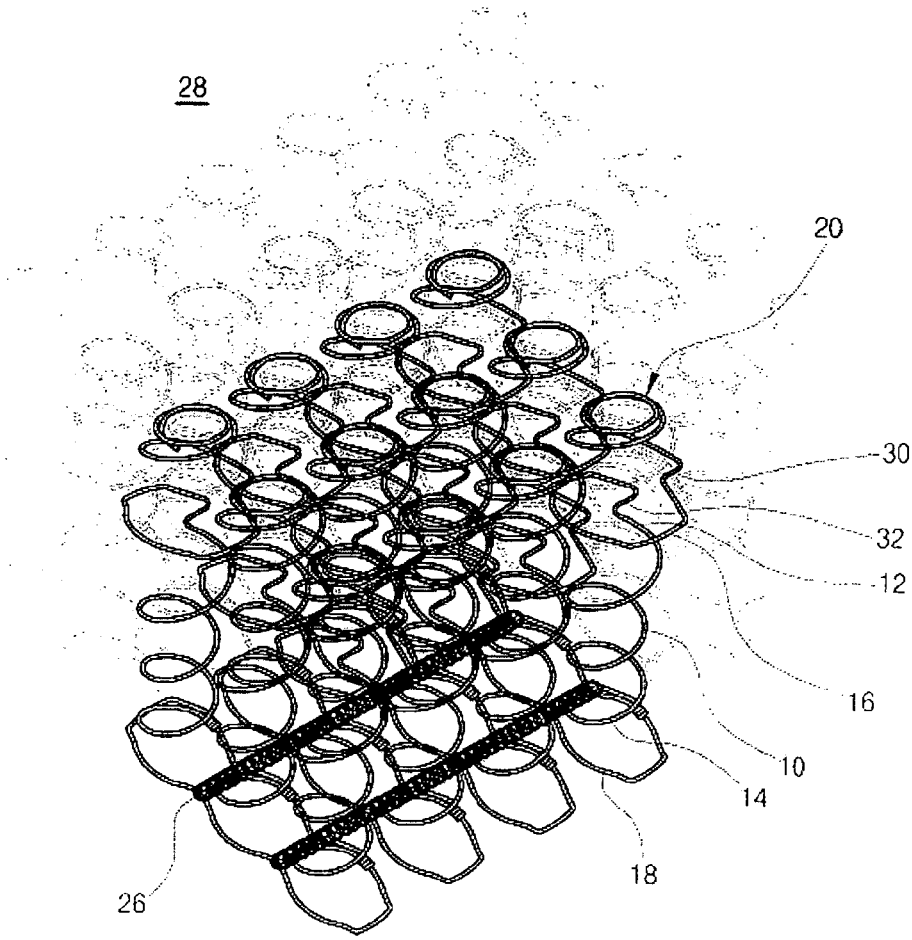
FIGS. 5*a*, 5*b* and 5*c* are a perspective view, a front view, and a side view illustrating the states where the spring structure according to the second embodiment of the present invention is assembled in a spring assembly.
Figure 5B:
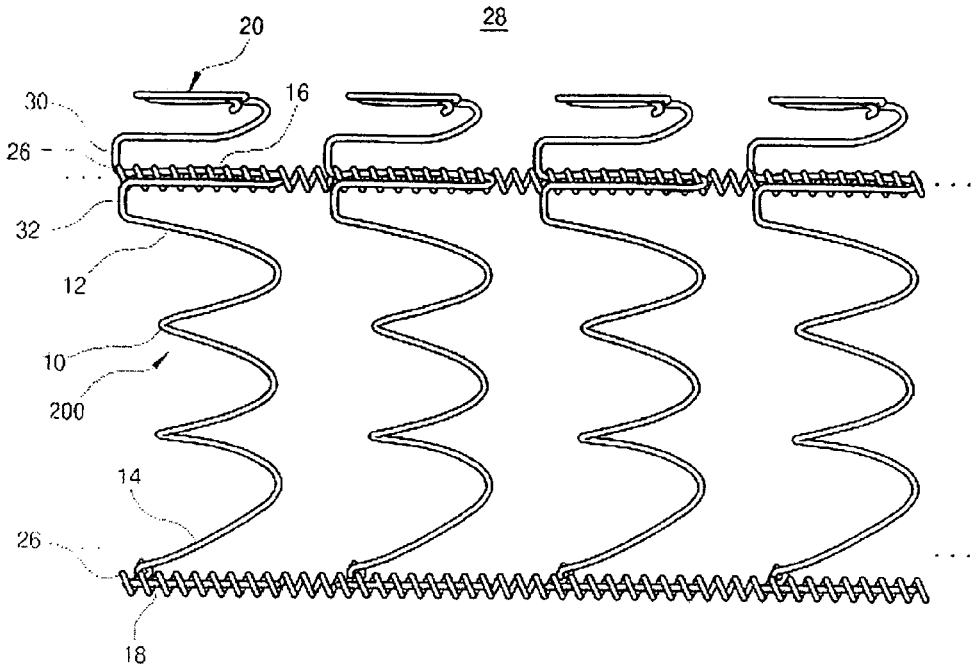
Figure 5C:
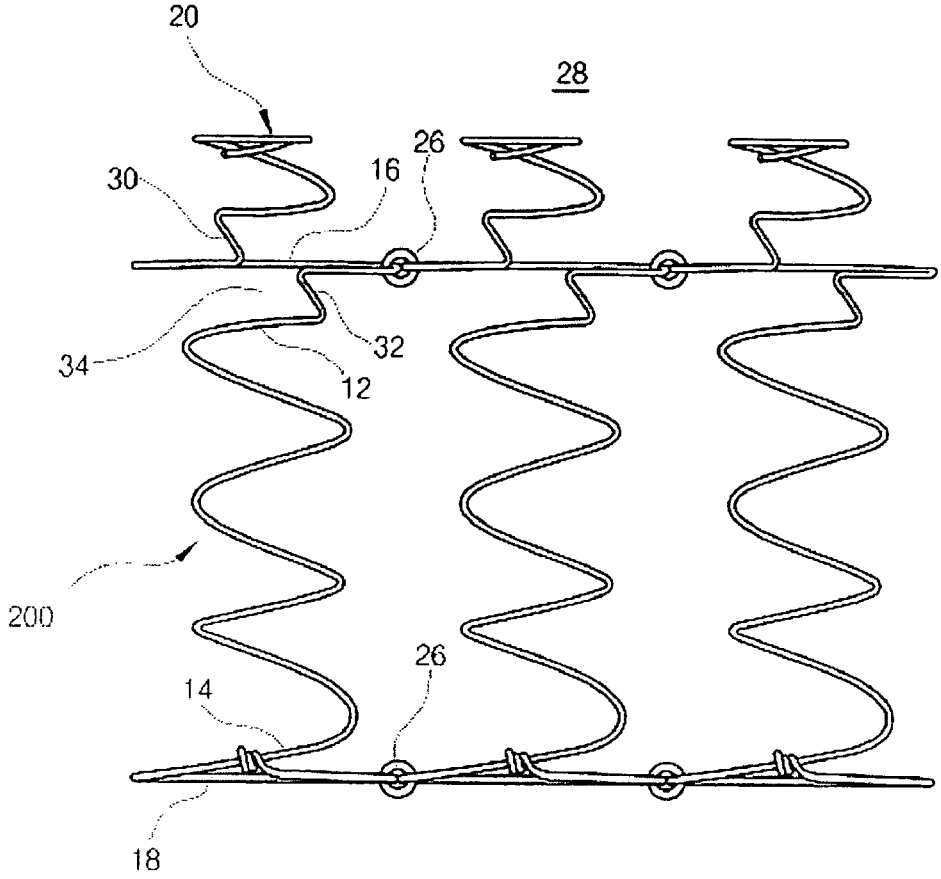
Figure 6A:
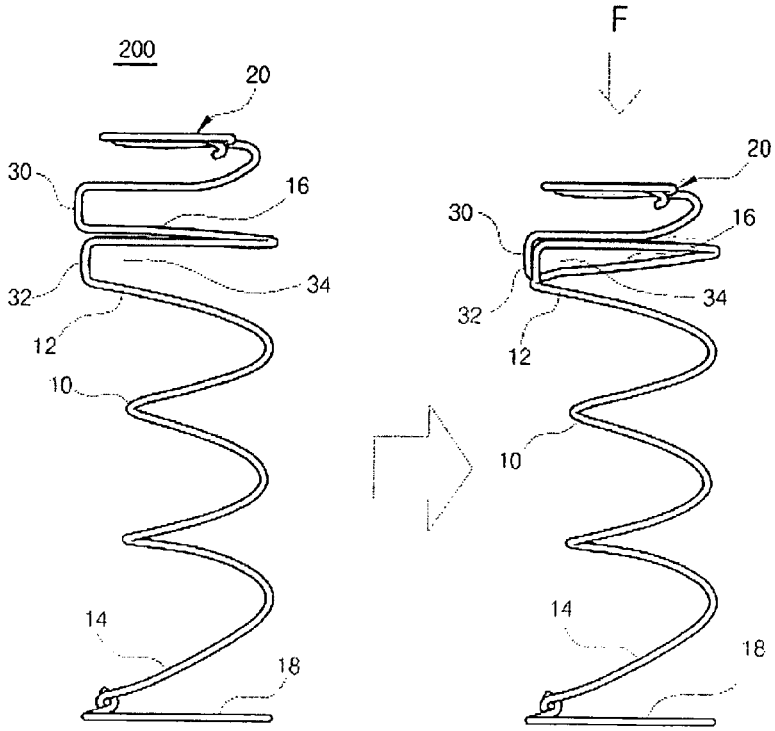
FIGS. 6*a* and 6*b* are a front view and a side view illustrating the compression actions of the spring structure according to the second embodiment of the present invention.
Figure 6B:
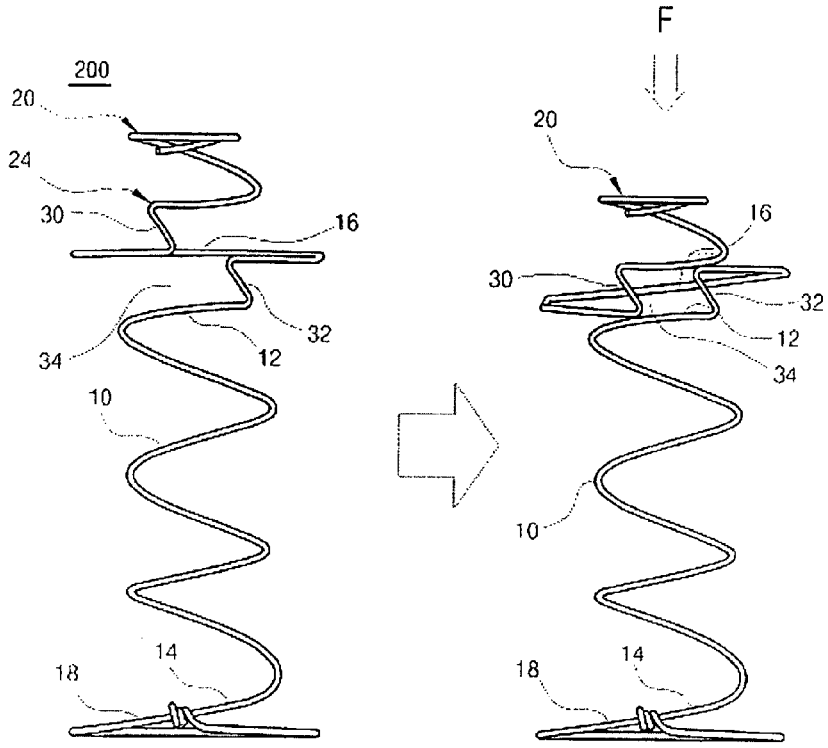

FIGS. 4*a*, 4*b* and 4*c* are a perspective view, a front view, and a side view illustrating a spring for a bed mattress according to the second embodiment of the present invention, FIGS. 5*a*, 5*b* and 5*c* are a perspective view, a front view, and a side view illustrating the states where the spring according to the second embodiment of the present invention is assembled in a spring assembly, and FIGS. 6*a* and 6*b* are a front view and a side view illustrating the compression actions of the spring according to the second embodiment of the present invention.

The spring structure 200 according to the second embodiment of the present invention is identical to the spring structure 100 according to the first embodiment, except that it further includes a second contact-preventing/rigidity-reinforcing end 32 formed at an uppermost winding 12 of the body spring 10 in such a fashion as to be bent in a "Z" shape.

More specifically, the second contact-preventing/rigidity-reinforcing end 32 is formed at a connection section between a terminating point of the uppermost winding 12 of the body spring 10 and a starting point of the upper end spring 16 in such a fashion as to be bent in a "Z" shape upwardly from the terminating point of the uppermost winding 12 to the starting point of the upper end spring 16.

At this time, as shown in FIG. 4*b*, a space defined behind the second contact-preventing/rigidity-reinforcing end 32, i.e., a space defined just above the uppermost winding of the body spring) is used as a contact-preventing space 34. The reason why the contact-preventing space 34 is formed is that when a load is applied to the bed mattress and simultaneously the exposure wire spring 20 is compressed, the first contact-preventing/rigidity-reinforcing end 30 is located at the space defined behind the second contact-preventing/rigidity-reinforcing end 32 while descending so that it does not come into close contact with an uppermost winding 12 of the body spring 10.

Figure 4D:
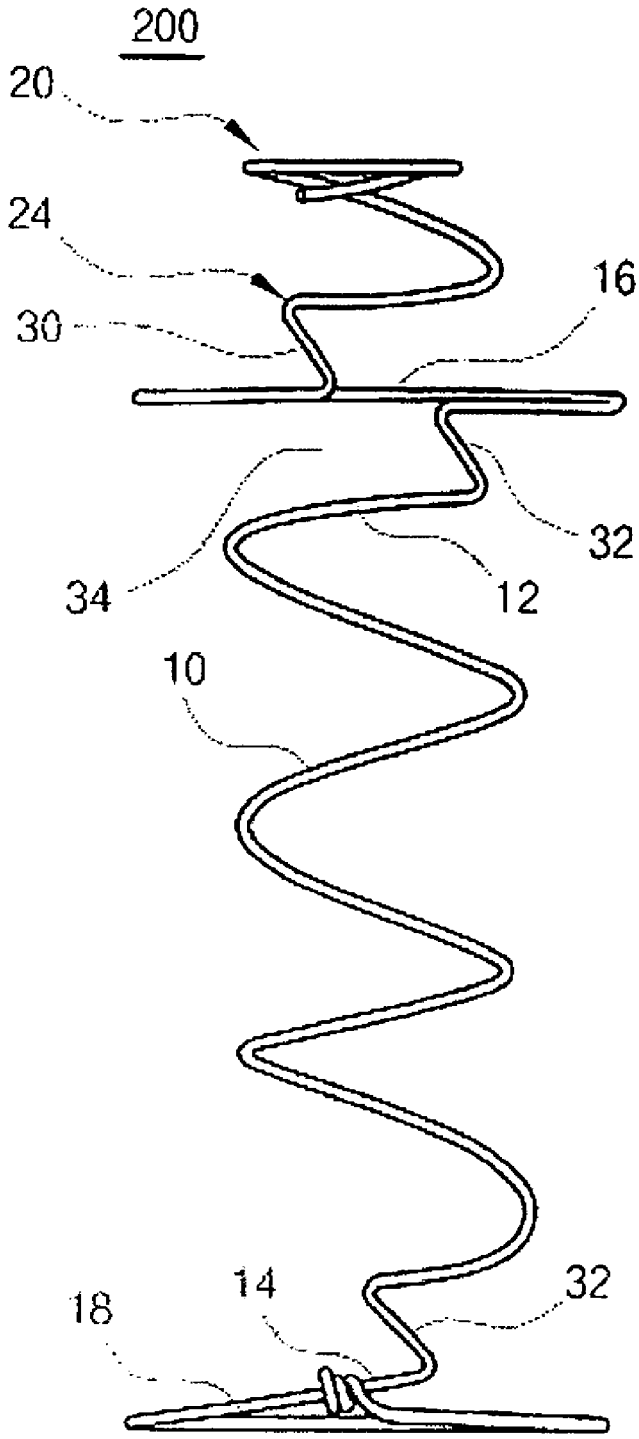
FIG. 4*d* is a side view illustrating a spring structure for a bed mattress which includes an additional contact-preventing/rigidity-reinforcing end in the spring structure of FIG. 4*c;*

In a modified embodiment, the spring structure of the second embodiment, as shown in FIG. 4*d*, may further include a fourth contact-preventing/rigidity-reinforcing end 32 formed at the lowermost winding 14 of the body spring 10 to further reinforce the support and resilient strength of the body spring 10.

That is, as shown in FIGS. 4*d*, 6*a* and 6*b*, when a load is exerted to the bed mattress to compress the exposure wire spring 20, the first contact-preventing/rigidity-reinforcing end 30 descends and is located at the space defined behind the second contact-preventing end 32, i.e., a contact-preventing space 34 so that the first contact-preventing/rigidity-reinforcing end 30 and the uppermost winding 12 of the body spring 10 do not come into close contact with each other, thereby fundamentally preventing generation of the noise due to the contact between the connection end portion 24 and the uppermost winding 12. In addition, when the first contact-preventing/rigidity-reinforcing end 30 descends, the fourth contact-preventing/rigidity-reinforcing end 32 formed at the lowermost winding 14 of the body spring 10 acts to support the body spring 10 so as to further reinforce the resilient strength of the body spring 10.

In addition, the exposure wire spring 20 is compressed, the first and fourth contact-preventing/rigidity-reinforcing ends 30 and 32 are enhanced in its rigidity while being bent in a "Z" shape, i.e., is enhanced in its rigidity required to support the exposure wire spring 20 so that a lateral displacement is not generated in which the exposure wire spring 20 is leaned to one side along with exertion of a load to the exposure wire spring 20 but stably ascends/descends vertically only so as to provide a uniform cushion sense.

As such, in the spring structures 100 and 200 according to the first and second embodiments of the present invention, the contact-preventing function of the first and fourth contact-preventing/rigidity-reinforcing ends 30 and 32 prevents generation of the noise and the enhanced rigidity prevents the lateral displacement of the exposure wire spring 20.

Figure 7:
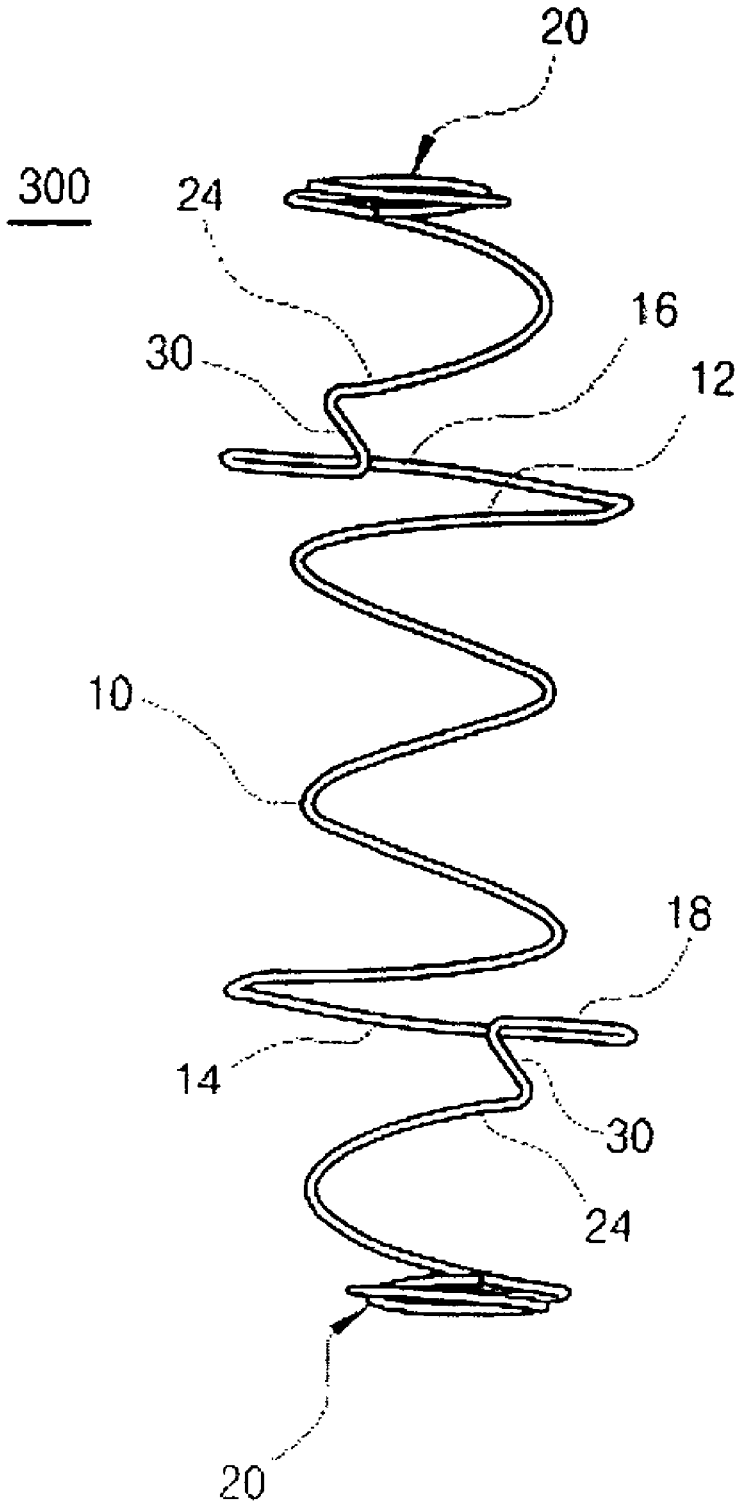
FIG. 7 is a side view illustrating a spring structure for a bed mattress according to the third embodiment of the present invention.

FIG. 7 is a side view illustrating a spring structure 300 for a bed mattress according to the third embodiment of the present invention.

The spring structure 300 according to the third embodiment is identical to that of the first embodiment except that it further includes a third contact-preventing/rigidity-reinforcing end. More specifically, an upper exposure wire spring 20 is connected integrally with the upper end spring 16 in such a fashion as to be disposed above the upper end spring 16 and a lower exposure wire spring 20 is connected integrally with the lower end spring 18 in such a fashion as to be disposed below the lower end spring 18. The spring structure 300 further includes a third contact-preventing/rigidity-reinforcing end 30 formed between the lower end spring 18 and the lower exposure wire spring 20 for the purpose of prevention of the noise due to any contact therebetween and reinforcement of rigidity.

Figure 8:
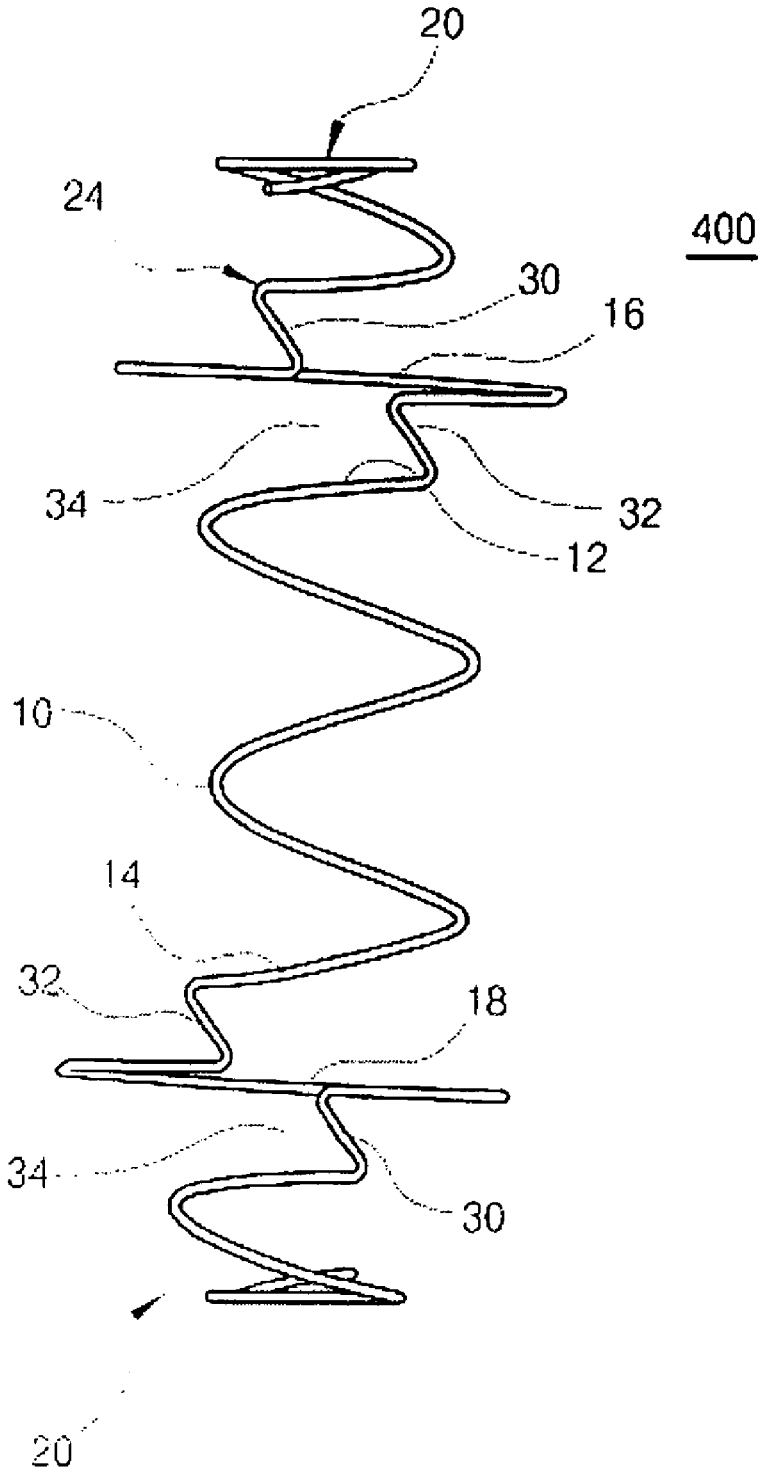
FIG. 8 is a side view illustrating a spring for a bed mattress according to the fourth embodiment of the present invention.

FIG. 8 is a side view illustrating a spring structure 400 for a bed mattress according to the fourth embodiment of the present invention. The spring structure 400 of the fourth embodiment is identical to that of the second embodiment except that it further includes a third contact-preventing/rigidity-reinforcing end and a fourth contact-preventing/rigidity-reinforcing end.

The spring 400 according to the fourth embodiment shown in FIG. 8 is characterized in that the exposure wire spring 20 is connected integrally with the upper end spring 16 in such a fashion as to be disposed above the upper end spring 16, and is connected integrally with the lower end spring 18 in such a fashion as to be disposed below the lower end spring 18. The spring structure 400 further includes the fourth contact-preventing/rigidity-reinforcing end 30 formed between the lower end spring 18 and the exposure wire spring 20, and the third contact-preventing/rigidity-reinforcing end 32 formed between the lower end spring 18 and the lowermost winding 14 of the body spring 10.

Figure 9A:
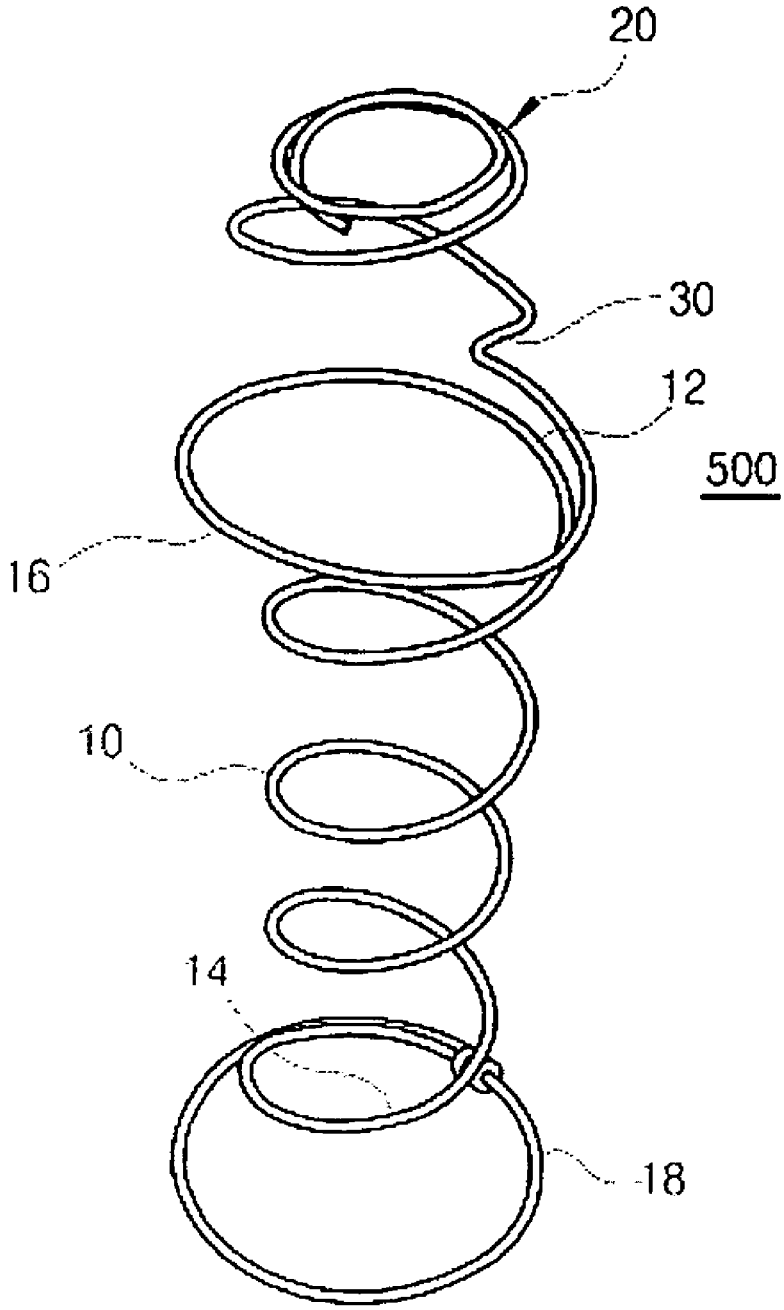
Figure 9B:
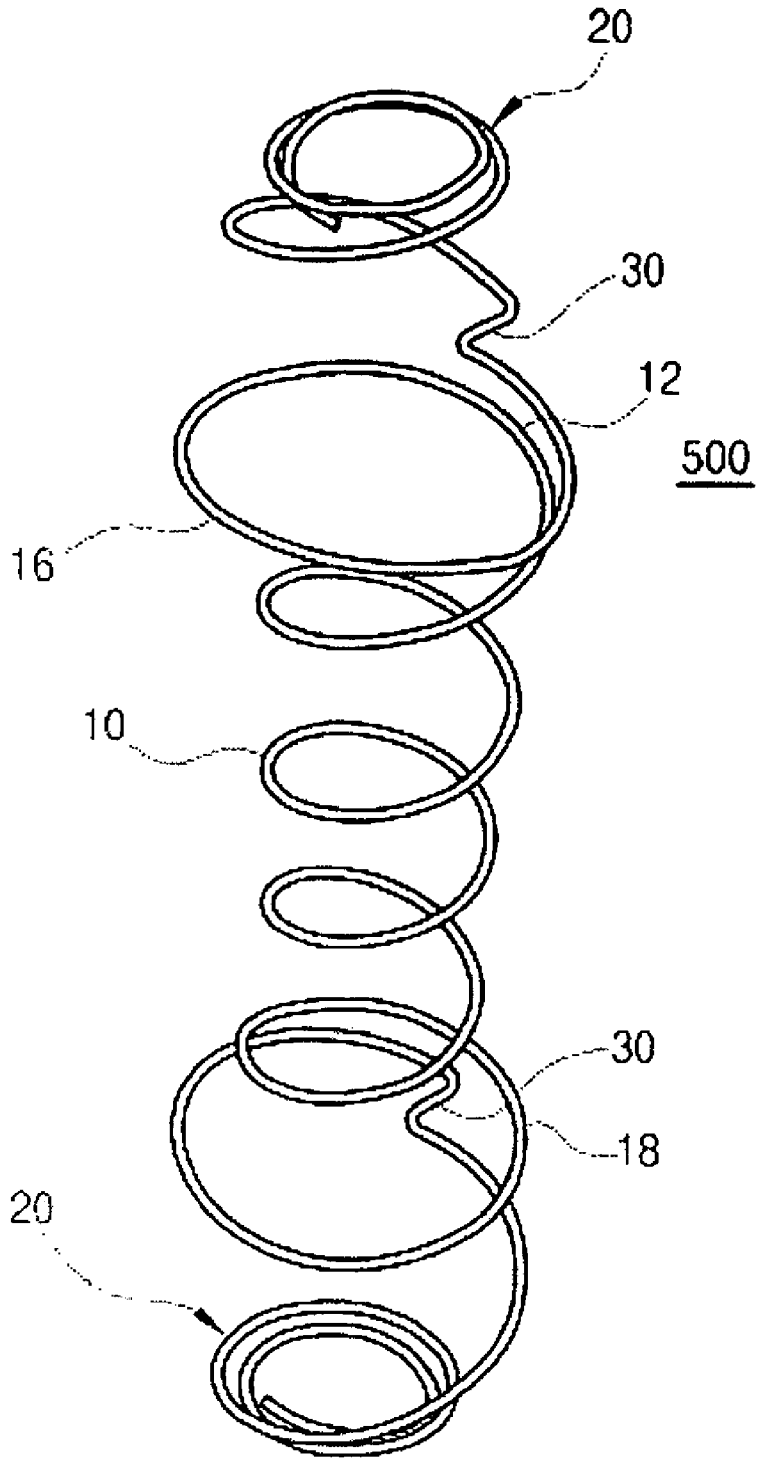

FIGS. 9*a* and 9*b* are perspective views illustrating a spring structure 500 for a bed mattress according to the fifth embodiment of the present invention, in which an exposure wire spring 20 is connected to an upper end portion of a conventional coil spring.

Figure 10A:
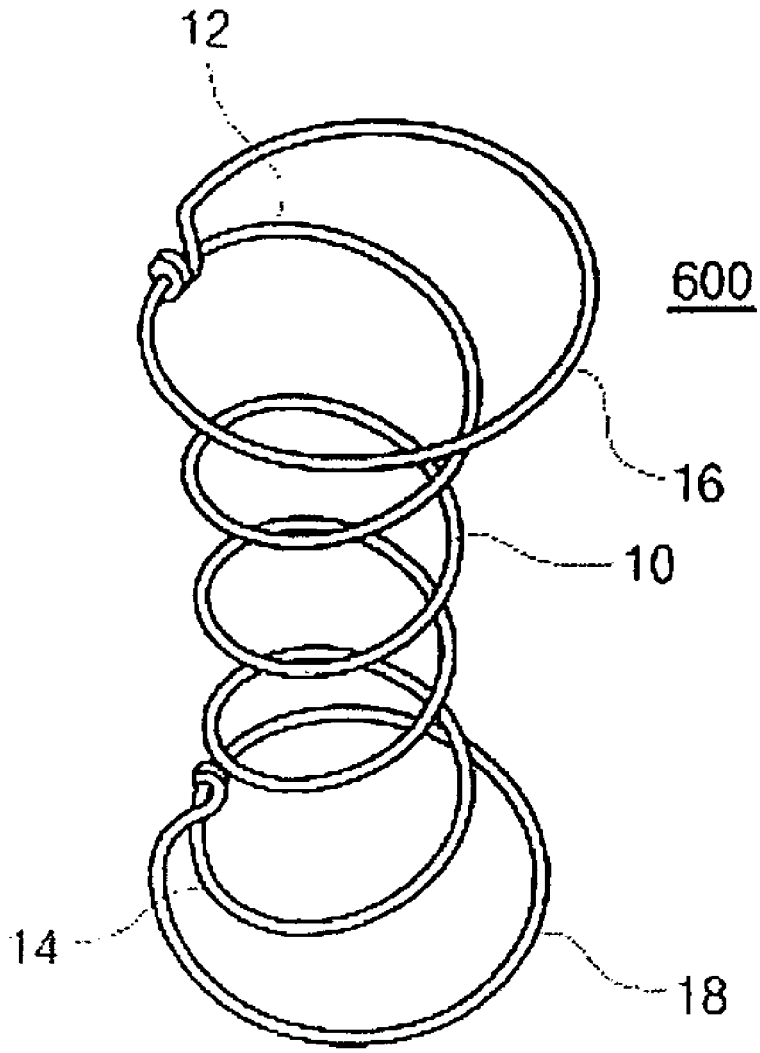
FIGS. 10*a* and 10*b* are a perspective view and a side view illustrating a conventional spring structure according to the prior art.
Figure 10B:
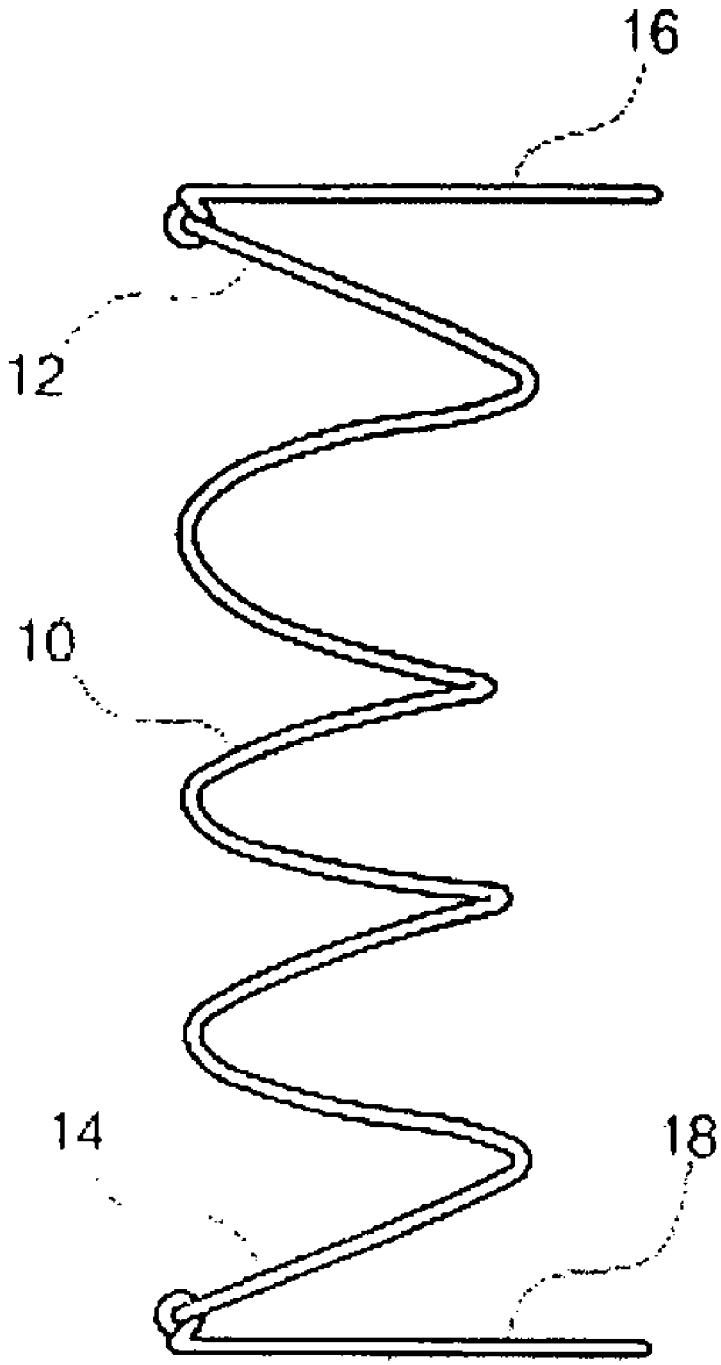
Figure 11A:
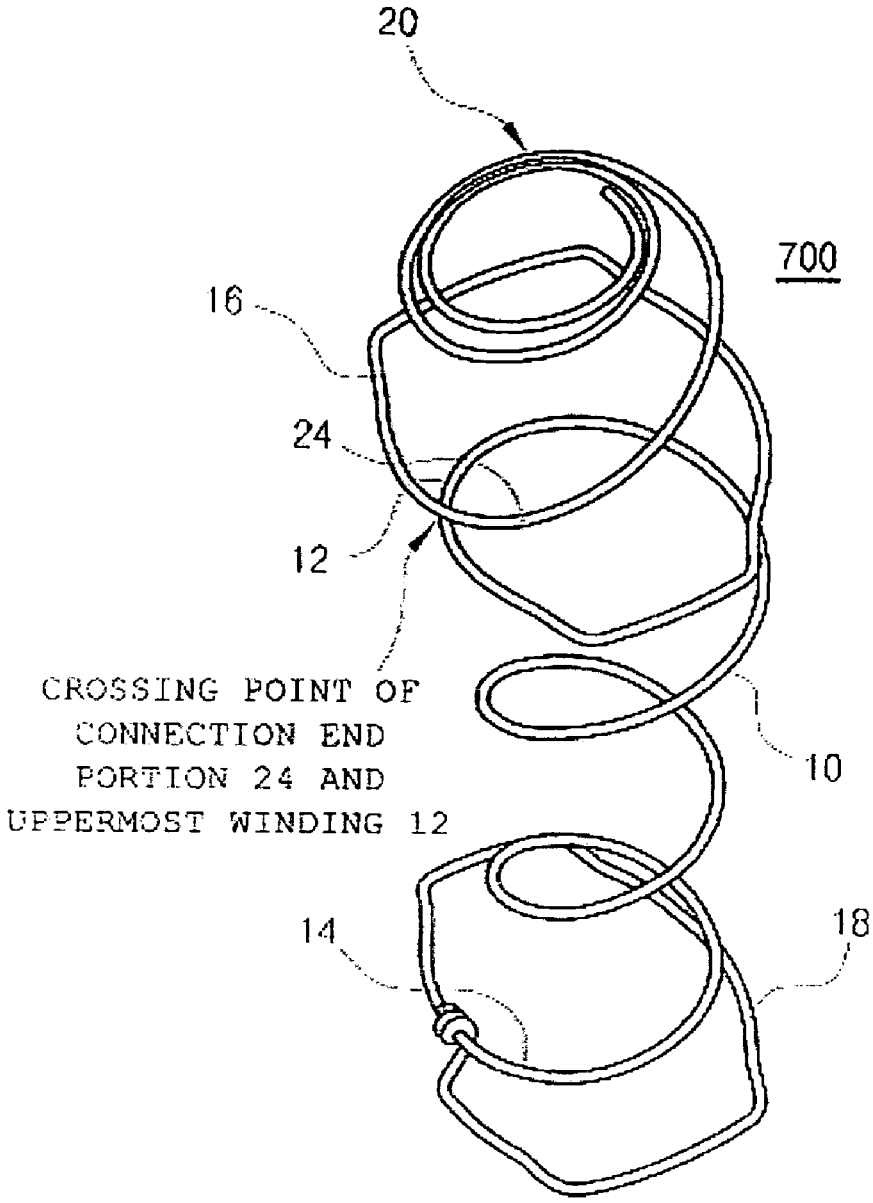
FIGS. 11*a*, 11*b* and 11*c* are a perspective view, a front view and a side view illustrating another conventional spring structure.
Figure 11B:
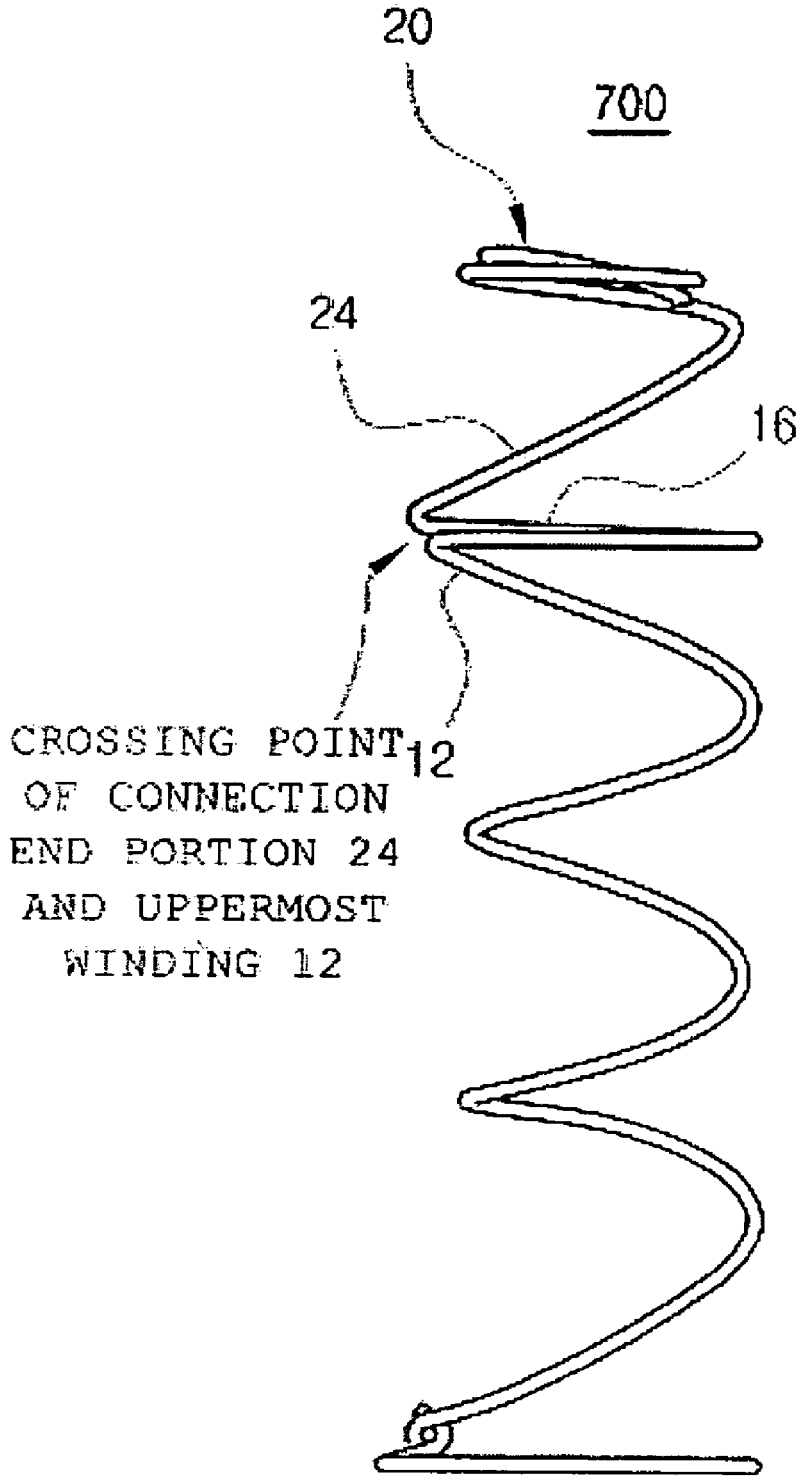
Figure 11C:
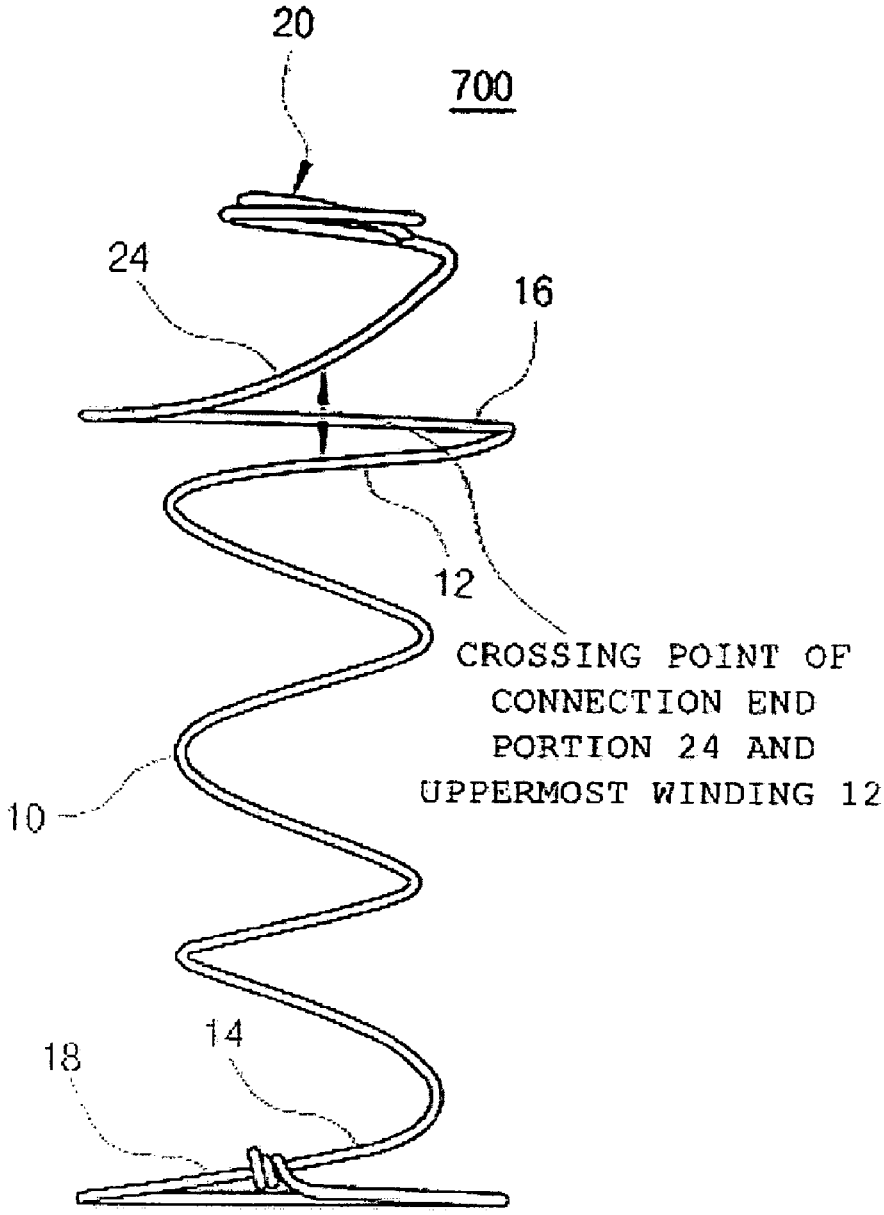
Figure 12:
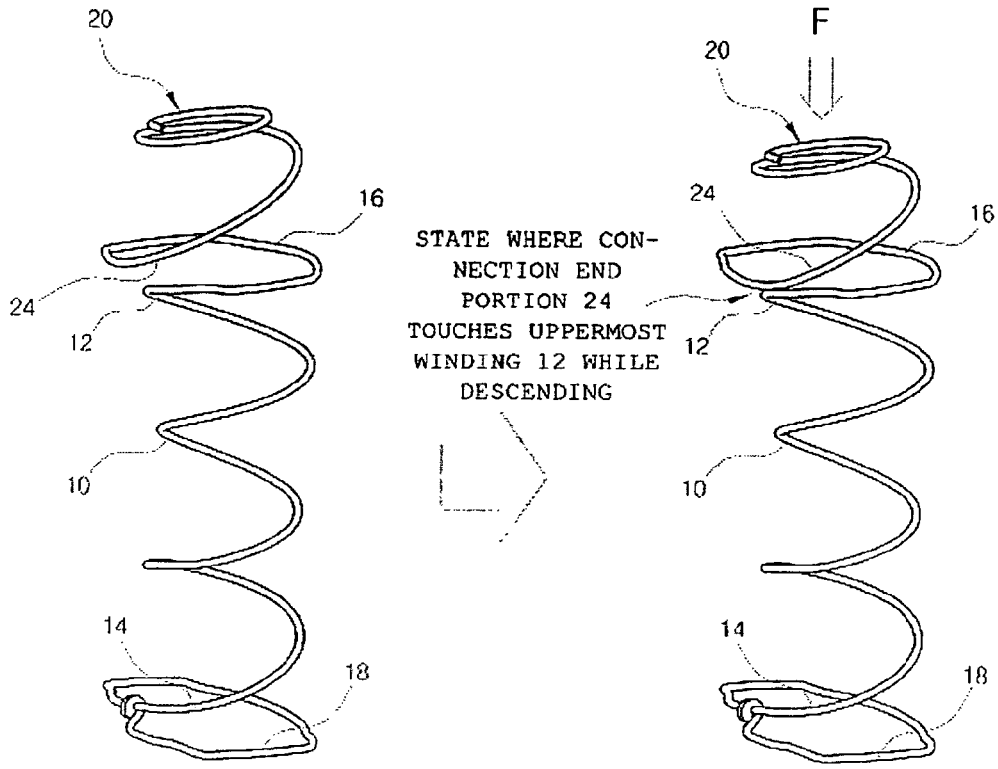
FIG. 12 is a perspective view illustrating the conventional spring structure of FIGS. 11*a* and 11*b* viewed from different angles for the sake of explanation of a disadvantage of the spring.
Figure 13:
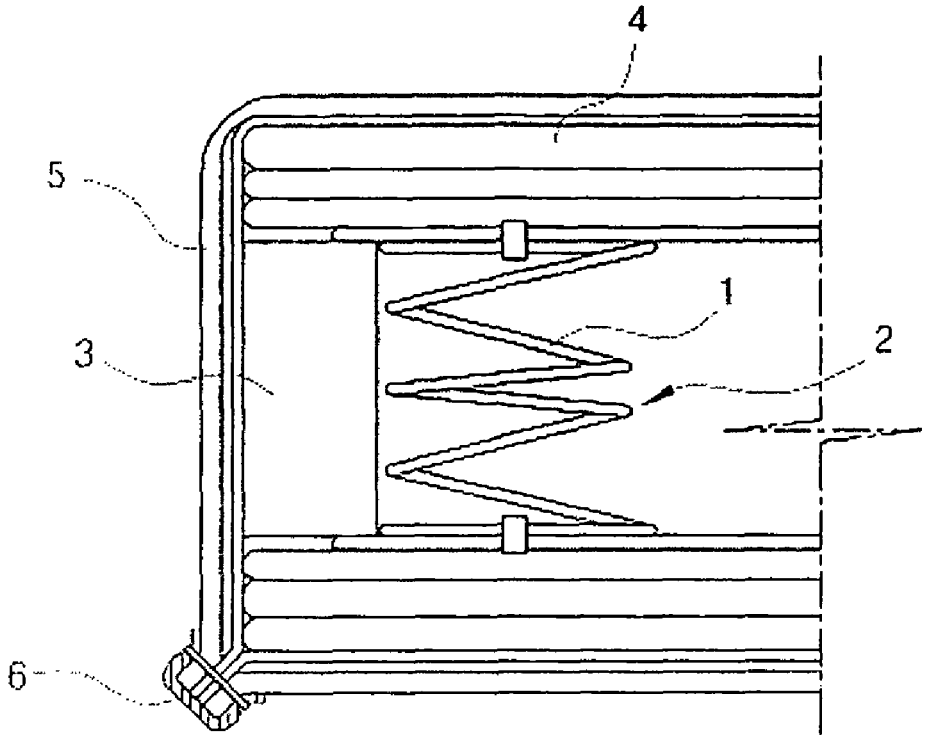
FIG. 13 is a cross-section view illustrating the structure of a conventional bed mattress.

More specifically, the spring structure 500 according to the fifth embodiment shown in FIGS. 9*a* and 9*b* is characterized in that the exposure wire spring 20 is connected integrally with the upper end spring 16 of a conventional coil shaped spring (see FIGS. 10*a* and 10*b*) in such a fashion as to be disposed above the upper end spring 16, or integrally with both the upper end spring and the lower end spring 18 in such a fashion as to be disposed above the upper end spring 16 and below the lower end spring 18. The spring structure 500 includes a first contact-preventing/rigidity-reinforcing end 30 formed between the upper end spring 16 and the upper exposure wire spring 20. Alternatively, the spring structure 500 includes, in addition to the first contact-preventing/rigidity-reinforcing end 30, a third contact-preventing/rigidity-reinforcing end 30 between the lower end spring 18 and the lower exposure wire spring 20.

As such, according to the present invention, the exposure wire spring 20 may be connected to the upper end spring of the body spring 10, or the upper end spring and the lower end spring of the body spring 10 irrespective of the kind of the spring. In case of such connection of the exposure wire spring 20, the first contact-preventing/rigidity-reinforcing end 30 alone is formed or the first contact-preventing/rigidity-reinforcing 30 end and at least one of the second, third, and fourth contact-preventing/rigidity-reinforcing ends 30 and 32 are formed to prevent the contact between the springs and a noise due to the contact. Further, the exposure wire spring 20 may be configured in such a fashion as to ascend/descend vertically only without the lateral displacement thereof through the reinforcement of support rigidity of the exposure wire spring 20.

In the meantime, the height of the contact-preventing/rigidity-reinforcing ends 30 and 32 is in the range between 5 to 60 mm. The reason of limiting the height is that if the height thereof is less than 5 mm, the formation itself of the contact-preventing/rigidity-reinforcing ends 30 and 32 are difficult, and if the height thereof is more than 60 mm, the intrinsic property of the spring is lost.

In addition, the inclination angle of the contact-preventing/rigidity-reinforcing ends 30 and 32 with respect to a vertical axis of the body spring 10 is limited to the range between 0° and 70°. The reason of limiting the inclination angle is that if the inclination angle is 0°, the rigidity of the exposure wire spring 20 is the most favorable, and if the inclination angle is more than 70°, the rigidity of the exposure wire spring 20 becomes weak and the impact-absorbing capacity of the exposure wire spring 20 is deteriorated.

The spring according to the respective embodiments of the present invention as described above is a spring having a dual buffer structure fabricated by any one of the following steps of:

i) forming the first contact-preventing/rigidity-reinforcing end 30 in a "Z" shape at a connection portion extending between the upper end spring 16 and the exposure wire spring 20 positioned above the upper end spring 16, ii) forming the first contact-preventing/rigidity-reinforcing end 30 in a "Z" shape at a connection portion extending between the upper end spring 16 and the exposure wire spring 20 positioned above the upper end spring 16, and the second contact-preventing/rigidity-reinforcing end 32 in a "Z" shape at a portion extending from the uppermost winding 12 of the body spring 10 to the upper end spring 16, iii) forming the first contact-preventing/rigidity-reinforcing end 30 in a "Z" shape at a connection portion extending between the upper end spring 16 and the exposure wire spring 20 positioned above the upper end spring 16, and the third contact-preventing/rigidity-reinforcing end 30 in a "Z" shape at a connection portion extending between the lower end spring 18 and the exposure wire spring 20 positioned below the lower end spring 18, iv) forming the first contact-preventing/rigidity-reinforcing end 30 in a "Z" shape at a connection portion extending between the upper end spring 16 and the exposure wire spring 20 positioned above the upper end spring 16 and further forming the second contact-preventing end 32 in a "Z" shape at a portion extending from the uppermost winding 12 of the body spring 10 to the upper end spring 16, the third contact-preventing/rigidity-reinforcing end 30 in a "Z" shape at a connection portion extending between the lower end spring 18 and the exposure wire spring 20 positioned below the lower end spring 18, and the fourth contact-preventing/rigidity-reinforcing end 32 in a "Z" shape at a portion extending from the lower end spring 18 to the lowermost winding 14 of the body spring 10, and v) forming the first contact-preventing/rigidity-reinforcing end 30 in a "Z" shape at a connection portion extending between the upper end spring 16 and the exposure wire spring 20 positioned above the upper end spring 16 and the second contact-preventing/rigidity-reinforcing end 32 in a "Z" shape at a portion extending from the uppermost winding 12 of the body spring 10 to the upper end spring 16, and the fourth contact-preventing/rigidity-reinforcing end 32 at a portion extending from the lower end spring 18 to the lowermost winding 14 of the body spring 10.

In the spring having the dual buffer structure, the body spring and the exposure wire spring perform a buffering function thereof separately depending on the magnitude of the load exerted to the bed mattress to thereby provide a stable and uniform cushion sense.

Particularly, the first contact preventing/rigidity-reinforcing end 30, or the first and second contact-preventing/rigidity-reinforcing ends 30 and 32 concurrently achieves a contact-preventing function in which the connection end portion is not in close contact with an uppermost winding and/or a lowermost winding of the body spring as well as a rigidity-reinforcing function in which the exposure wire spring is guided to stably ascend/descend vertically only, but not displaced laterally, when a load is exerted to the exposure wire spring, to thereby provide advantages of preventing the deformation of the spring and prolonging the lifespan of the spring.

As apparent from the foregoing, according to the inventive spring structure having a contact-preventing and rigidity-reinforcing function for a bed mattress, the structure of a connection end portion for connecting a body spring and an exposure wire spring to each other is improved such that the connection end portion is not in close contact with an uppermost winding of the body spring and the rigidity required to support the exposure wire spring is enhanced, so that the following merits are provided:

a) The first contact-preventing/rigidity-reinforcing end is formed at a connection end portion extending between the body spring and the upper exposure wire spring, so that when the exposure wire spring is compressed by means of a load exerted to the bed mattress, the first contact-preventing/rigidity-reinforcing end does not bring into contact with the uppermost winding of the body spring while descending, thereby easily preventing a deformation of the spring due to a frictional contact, fundamentally preventing a contact noise, and preventing the lateral displacement of the exposure wire spring while guiding only the vertical movement of the exposure wire spring.

b) The second contact-preventing/rigidity-reinforcing end is further formed between the upper end spring and the body spring in addition to the first contact-preventing/rigidity-reinforcing end, so that the first contact-preventing/rigidity-reinforcing end is positioned at the space defined behind the second contact-preventing/rigidity-reinforcing end while descending or passing by the uppermost winding of the body spring without touching the uppermost winding while descending, thereby further easily preventing a deformation of the spring due to a frictional contact, fundamentally preventing a contact noise, and providing a structure having a greater rigidity for preventing the lateral displacement of the exposure wire spring.

c) Resultantly, the present invention concurrently achieves a contact-preventing function in which the connection end portion is not in close contact with an uppermost winding and/or a lowermost winding of the body spring as well as a rigidity-reinforcing function in which the exposure wire spring is guided to stably ascend/descend vertically only, but not displaced laterally, when a load is exerted to the exposure wire spring, to thereby provide advantages of preventing the deformation of the spring and prolonging the lifespan of the spring.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A spring structure having a contact-preventing and rigidity-reinforcing function for a bed mattress which comprises a body spring formed in a coil shape, upper and lower end springs wound and extending horizontally at upper and lower portions of the body spring, a first exposure wire spring formed integrally with the upper end spring in such a fashion as to be disposed above the upper end spring, the first exposure wire spring comprising a plurality of windings, and a first connection end portion for integrally connecting the upper end spring and the first exposure wire spring to each other, wherein a first contact-preventing/rigidity-reinforcing end is formed at the first connection end portion in such a fashion as to be bent in a "Z" shape upwardly from a distal end of the upper end spring positioned outwardly from an uppermost winding of the body spring so that the first exposure wire spring is prevented from being in contact with the uppermost winding of the body spring and with the upper end spring, and so that rigidity of the first contact-preventing/rigidity-reinforcing end is reinforced.

2. The spring structure according to claim 1, further comprising a second contact-preventing/rigidity-reinforcing end formed at the uppermost winding of the body spring positioned below the first contact-preventing/rigidity-reinforcing end in such a fashion as to be bent in a "Z" shape upwardly from a terminating point of the uppermost winding of the body spring to a starting point of the upper end spring.

3. The spring structure according to claim 1, further comprising a second exposure wire spring formed integrally with the lower end spring in such a fashion as to be disposed below the lower end spring, and a second connection end portion for integrally connecting the lower end spring and the second exposure wire spring to each other, and a third contact-preventing/rigidity-reinforcing end formed at the second connection end portion in such a fashion as to be bent in a "Z" shape downwardly from a distal end of the lower end spring positioned outwardly from a lowermost winding of the body spring.

4. The spring structure according to claim 3, further comprising a second contact-preventing/rigidity-reinforcing end formed at the uppermost winding of the body spring positioned below the first contact-preventing/rigidity-reinforcing end in such a fashion as to be bent in a "Z" shape upwardly from a terminating point of the uppermost winding of the body spring to a starting point of the upper end spring, and a fourth contact-preventing/rigidity-reinforcing end formed at the lowermost winding of the body spring positioned below the first contact-preventing/rigidity-reinforcing end in such a fashion as to be bent in a "Z" shape downwardly from a terminating point of the lowermost winding of the body spring to a starting point of the lower end spring.

5. The spring structure according to claim 2 further comprising a fourth contact-preventing/rigidity-reinforcing end is formed at a lowermost winding of the body spring in such a fashion as to be bent in a "Z" shape downwardly from a terminating point of the lowermost winding of the body spring to a starting point of the lower end spring.

6. The spring structure according to claim 1, wherein the first contact-preventing/rigidity-reinforcing end has a height of 5 to 60 mm.

7. The spring structure according to claim 2, wherein each of the first and second contact-preventing/rigidity-reinforcing ends have a height of 5 to 60 mm.

8. The spring structure according to claim 3, wherein each of the first and third contact-preventing/rigidity-reinforcing ends have a height of 5 to 60 mm.

9. The spring structure according to claim 4, wherein each of the first, second, third, and fourth contact-preventing/rigidity-reinforcing ends have a height of 5 to 60 mm.

10. The spring structure according to claim 5, wherein each of the first, second, and fourth contact-preventing/rigidity-reinforcing ends have a height of 5 to 60 mm.

11. The spring structure according to claim 1, wherein the "Z"-shape bent angle of the first contact-preventing/rigidity-reinforcing end with respect to a vertical axis of the body spring is in the range between 0° and 70°.

12. The spring structure according to claim 2, wherein the "Z"-shape bent angle of the first and second contact-preventing/rigidity-reinforcing ends with respect to a vertical axis of the body spring is in the range between 0° and 70°.

13. The spring structure according to claim 3, wherein the "Z"-shape bent angle of the first and third contact-preventing/rigidity-reinforcing ends with respect to a vertical axis of the body spring is in the range between 0° and 70°.

14. The spring structure according to claim 4, wherein the "Z"-shape bent angle of the first, second, third, and fourth contact-preventing/rigidity-reinforcing ends with respect to a vertical axis of the body spring is in the range between 0° and 70°.

15. The spring structure according to claim 5, wherein the "Z"-shape bent angle of the first, second, and fourth contact-preventing/rigidity-reinforcing ends with respect to a vertical axis of the body spring is in the range between 0° and 70°.

* * * * *